US007824116B2

(12) United States Patent
Lyman

(10) Patent No.: US 7,824,116 B2
(45) Date of Patent: Nov. 2, 2010

(54) SELF-CENTERING MEDIA SUPPORT ASSEMBLY AND METHOD OF USING THE SAME

(75) Inventor: Roy Patrick Lyman, Coventry, RI (US)

(73) Assignee: ZIH Corp., Hamilton Parish (BM)

( * ) Notice: Subject to any disclaimer, the term of this patent is extended or adjusted under 35 U.S.C. 154(b) by 711 days.

(21) Appl. No.: 11/284,061

(22) Filed: Nov. 21, 2005

(65) Prior Publication Data

US 2006/0216098 A1 Sep. 28, 2006

Related U.S. Application Data

(60) Provisional application No. 60/630,647, filed on Nov. 24, 2004.

(51) Int. Cl.
*B41J 15/00* (2006.01)
*B41J 15/04* (2006.01)

(52) U.S. Cl. ..... 400/613; 400/611; 347/105; 347/109; 271/171

(58) Field of Classification Search ..... 400/613; *B41J 15/00, 15/04*
See application file for complete search history.

(56) References Cited

U.S. PATENT DOCUMENTS 2,772,110 A * 11/1956 Petrochko ..... 292/341.17
3,936,086 A * 2/1976 Berkowitz ..... 292/341.17
4,973,091 A * 11/1990 Paulson et al. ..... 292/51
6,158,342 A * 12/2000 Moore ..... 101/407.1
6,609,844 B1 * 8/2003 Petteruti et al. ..... 400/88
7,295,132 B2 * 11/2007 Steiner ..... 340/825.49
2003/0141655 A1 * 7/2003 Bryer ..... 271/264
2006/0024114 A1 * 2/2006 Lyman et al. ..... 400/613
2006/0028528 A1 * 2/2006 Klein et al. ..... 347/109

* cited by examiner

*Primary Examiner*—Ren Yan
*Assistant Examiner*—'Wyn' Q Ha
(74) *Attorney, Agent, or Firm*—Alston & Bird LLP

(57) ABSTRACT

A printer assembly for dispensing a printer media and printing on the printer media as it is dispensed. The printer assembly includes a housing with a container portion and a lid portion, and a latching mechanism configured to coordinate latching, unlatching and biasing of the lid with locking and unlocking of the printer media supply from a media supply assembly. The latching mechanism may be configured to urge the lid portion away from the container portion when the lid portion is unlatched. The latching mechanism can include a locking surface that is configured to engage a locking surface on relatively movable media support members, restraining relative movement of the media support members and locking down the media supply therein when the latching the lid portion closed. The locking surface is positioned external to opposing, relatively movable surfaces of the media support members enabling a compact assembly for hand held printers.

11 Claims, 19 Drawing Sheets

SELF-CENTERING MEDIA SUPPORT ASSEMBLY AND METHOD OF USING THE SAME

CROSS-REFERENCE TO RELATED APPLICATIONS

This application claims priority from U.S. Provisional Application No. 60/630,647, filed Nov. 24, 2004, which is hereby incorporated herein in its entirety by reference.

BACKGROUND OF THE INVENTION

1. Field of the Invention

The present invention involves the of a media support assembly in a printer, and more particularly the use of a self-centering media support assembly in a handheld printer.

2. Description of Related Art

Desktop printers typically require some type of a media supply (e.g., paper or labels) from which media is drawn and dispensed against a print head. The print head prints on the media (e.g., with ink, toner or heat) as it is passes against the print head. Eventually, after a certain amount of printing, the media supply is exhausted and needs to be replaced with a fresh media supply. Replacement of the media supply typically involves opening a housing of the desktop printer by unlocking one or more latching mechanisms, at which point a tray of the housing is released to allow access to the media supply of a media dispenser. The user can then refill or replace the media in the media dispenser, such as by placing a fresh stack of paper in the tray.

In handheld printers, size constraints typically dictate that the supply of printer media be more compact. For this purpose, rolls of media are often employed. Rolls of media typically need to be positioned with respect to the print head. U.S. Pat. No. 6,609,844 ("the '844 patent), for example, discloses a portable printer 10 having an automatic print alignment. The portable printer includes a housing 12 with an upper housing section 12*a* which mates with a lower housing section 12*b*, and a cover 14 for a compartment 16 in the printer which receives a roll of paper or label stock, as shown in FIGS. 1 and 2 of the '844 patent. The roll 15 is made of thermally sensitive paper or label stock that is pulled upwards by a platen roller 24 over a print head 33 as it prints on the paper or label stock.

Placement and replacement of the roll is facilitated by a centering mechanism 36 that ensures that each new roll is centered with regard to the print head, regardless of the width of the roll, as shown in FIGS. 3 and 4 of the '844 patent. The centering mechanism includes two spindles 38 in the compartment for engaging the roll's tubular core and a rack and pinion assembly that enables movement of the spindles with respect to a center position. The rack and pinion assembly includes two racks 40*a* and 40*b* each with teeth engaging the teeth 42*a* of a common pinion or gear 42 and each supporting one of the spindles. An extension spring 56 has one end attached to rack 40*a* and applies tension on the rack 40*a* directly and on the rack 40*b* through the pinion, thereby drawing the spindles together to hold a roll of printer media when placed between the spindles.

A locking mechanism is provided to lock the centering mechanism from substantial movement when the cover is latched closed by a latch member 68. A rack lock 86 of the mechanism has a cylindrical shape with an open end 86*a* and projections 87 for engaging additional pinion teeth 54. The rack lock is mounted on a plate 90 having two notches 92 mounted to slide along two tracks 93 extending downwardly from a frame 30 of the printer. This positioning allows the rack lock to engage the pinion teeth with only a slight forward movement.

A compression spring 96 biases the rack lock away from the pinion teeth. However, the bias of the compression spring can be overcome by movement of the latch member to the closed position which depresses a lever 110 and turns a shaft 102 supporting the lever. Turning of the shaft pushes the rack lock forward against the bias of the compression spring until the rack lock engages the pinion, halting movement of the pinion, the racks and the spindle members. Latching the cover of the printer, therefore, locks the media roll in a centered position with respect to the print head to facilitate printing. Although the printer of the '844 patent advantageously centers and locks a media roll in place for a hand held printer, additional improvements in the compactness and simplicity of the operation of hand held printers is always desirable. In particular, the complexity of the centering mechanism detracts from its impact resistance. For instance, during drop tests complex centering mechanisms have a tendency to stop functioning due to the centering mechanisms "jumping track," experiencing tooth failures or skipping cogs.

Therefore, it would be advantageous to have a printer that has a simplified mechanism for centering and holding media. Also, it would be advantageous to have a centering mechanism that is fairly robust and resistant to drops and other impacts. It would be further advantageous if the simplified mechanism were also compact so as to facilitate its use in a hand held printer.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

Figure 1:
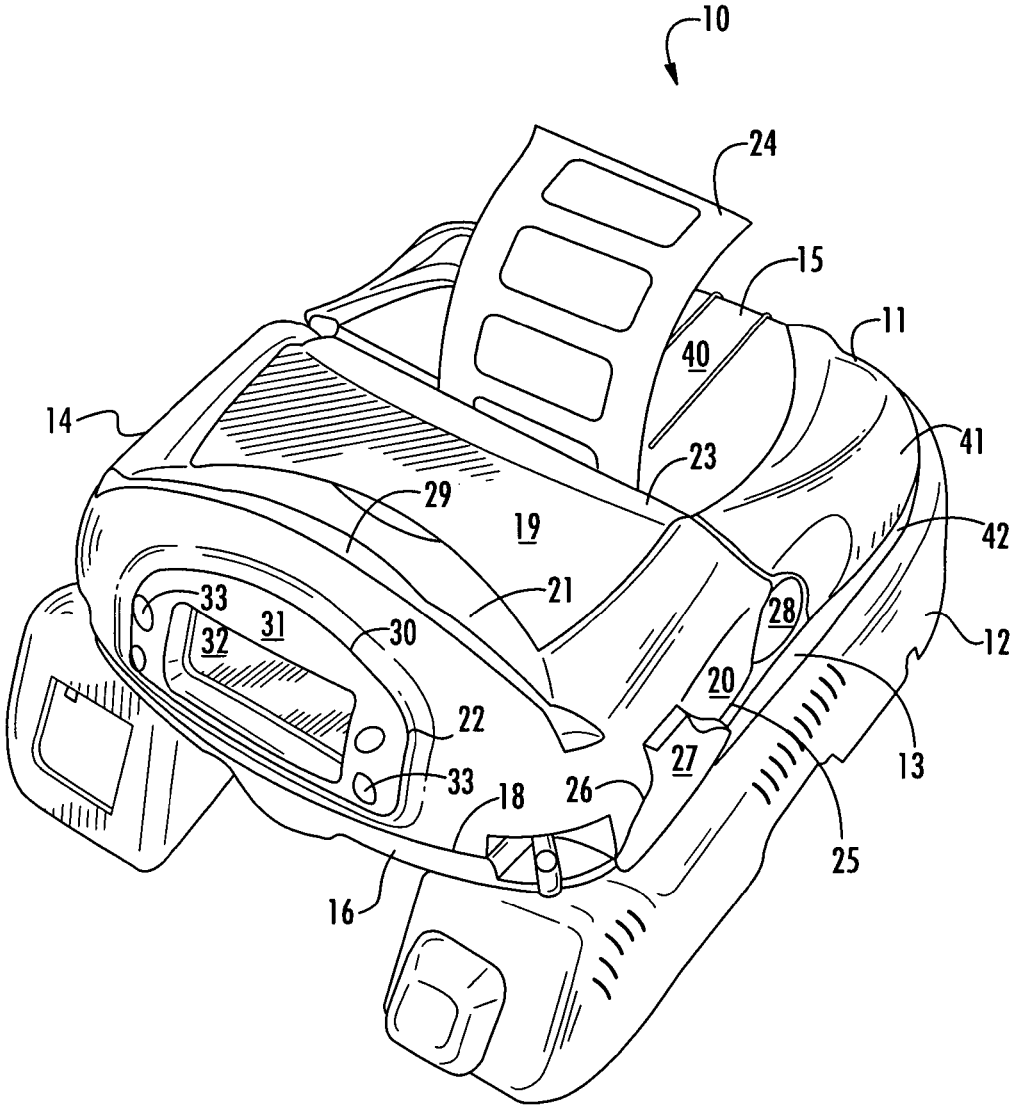
FIG. 1 is a perspective view of a printer of one embodiment of the present invention.

The present invention addresses the above needs and achieves other advantages by providing a printer assembly for dispensing media from a media supply and for printing on the media supply as it is dispensed. The printer assembly includes media support members for gripping the media supply attached to media support arms. Coupling movement of the media support arms, and hence coupling movement the media support members for a centering effect, are one or more movable engagement members. These movable engagement members are configured to engage engagement surfaces of the media support arms at positions offset from a center line of the media support members for robust operation. As examples, the movable engagement members can include a pair of spaced pinions positioned between racks on the media support arms and on opposite sides of the center line, one or more pinions having centers offset from the center line, a linkage with ends offset from the center line or a pinion and belt assembly wherein the pinions are spaced apart on opposite sides of the center line.

In one embodiment, the present invention includes a printer assembly for dispensing a media from a media supply and printing on the media as it is dispensed. A pair of media support members are configured to grip the media supply when the media supply is positioned between the media support members. The media support members define a center line or point that is positioned halfway between the media support members and the media supply. A media dispenser is configured to dispense the media from the media supply while held between the media support members. The printer assembly also includes a print head configured to print on the media as it is dispensed. A plurality of media support arms, each of which is attached to one of the media support members, are also included in the printer assembly. The media support arms are movable relative to each other so as to urge the media support members together to grip the media supply. In addition, each of the media support arms includes an engagement surface. The printer assembly further includes a movable engagement member (or a plurality of engagement members) positioned between two relatively movable ones of the media support arms. The movable engagement member is configured to engage (directly or indirectly) the engagement surface of each of the relatively movable media support arms. Such engagement couples movement of the relatively movable media support arms so that the media supply is centered between the media support members when the support arms are urged together, such as by a biasing mechanism. Advantageously, the engagement surfaces of the media support arms, which are engaged by the engagement members for coupling movement, have a position offset from the center line so as to provide robust operation.

The movable engagement members may engage and couple movement of the media support arms in several ways. For example, in another embodiment, a pair of movable engagement members may be used wherein the engagement members are spaced apart from each other on opposite sides of the center line. In this aspect, each of the movable engagement members may directly engage the engagement surface of one, or both, of the relatively movable media support arms. For example, the media support arms may include rack surfaces positioned opposite and parallel each other and the moveable engagement members may be a pair of pinions positioned between the rack surfaces and on opposite sides of the center line.

In another embodiment, the present invention includes a plurality of media support arms including a first, second and third media support arms preferably extending parallel to each other. The first and second media support arms are fixed to each other. The third media support arm extends between, and is relatively movable with respect to, the first and second media support arms. Included on the third media support arm are opposite positioned engagement surfaces. One of a pair of engagement members extends between, and engages engagement surfaces of, the first and third media support arms. A second one of the pair of engagement members extends between, and engages engagement surfaces of, the second and third media support arms. In another aspect, the engagement surfaces can be rack surfaces and the engagement members rotatable pinions spaced apart on opposite sides of the center line so as to engage the rack surfaces.

In yet another embodiment, the present invention includes a first, second and third movable engagement members. The third movable engagement member is configured to extend between the first and second movable engagement members so that movement of all three movable engagement members is coupled. Preferably, but not necessarily, the movable engagement members are rotatable pinions that are approximately equal in size.

In another embodiment, the moveable engagement members are a pair of rotatable pinions with a belt extending over the pinions. The belt is attached to the engagement surface of each of the relatively movable media supports.

In yet another embodiment, the movable engagement member includes a linkage with equal-length links wherein ends of the linkage are each attached to a respective one of the engagement surface of the relatively movable media supports.

The present invention has many advantages. The various embodiments of the media centering devices, including the use of different combinations and positioning of the pinions, or other movement coupling devices, to engage the rack arms at off center positions that provides additional options for placing other components of the printer. Use of multiple pinions to engage the pinion face of each rack arm increases the amount of engagement surface for further stability. Stability is further aided by positioning the pinions to engage each of the rack arm directly without intervening pinions. Direct engagement also allows the use of larger diameter pinions which have larger engagement surfaces. Use of the belt extending over the pinions also increases the size of the engagement surface for improved impact resistance. The use of linkages can avoid the potential for disengagement of pinion or rack teeth during a drop or impact.

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

A handheld printer 10 of one embodiment of the present invention is shown in FIGS. 1-13. Generally, the printer includes a rounded, rectangular housing 11 that can be supported within a cradle 12, as shown in FIG. 1. The housing has three main sub-portions, including a base 13, a wireless card processor cover 14 and a media supply lid or cover 15.

The base 13 has a rectangular shape with a wall structure 16 extending upwards from a bottom surface 17 to support and contain various electronic and mechanical assemblies of the printer 10. The wall structure 16 ends in a free edge 18 that extends continuously around the rectangular shape of the base 13 and is configured to mate with the card processor cover 14 and the media supply cover 15.

The wireless card processor cover 14 includes a deck portion 19, a pair of sidewalls 20, an information card receiving portion or communications module 21 and a display portion 22. The deck portion 19 is a relatively planar surface that extends between the pair of sidewalls 20 and defines one edge of a media dispensing opening 23 through which a strip of media 24 extends, as shown in FIG. 1. Each of the sidewalls 20 includes a free edge 25 that is configured to mate with the media supply cover 15 and with the free edge 18 of the base wall structure 16.

The wall structure 16 of the base 13 and one of the sidewalls 20 together define an input/output (I/O) opening 26 for receiving and connecting various input and output devices. Covering the I/O opening is a flexible, resilient I/O cap or cover 27. A portion of the free edge 25 of the same one of the sidewalls 20 defining the I/O opening 26 has an arc shape to provide clearance (along with an arc shape defined by the media supply cover 15 and a semi-circle defined by the free edge 18 of the base wall structure 16) for a latch button 28 used to open the media supply cover 15, as will be described in more detail below.

Abutting the deck portion 19 is the information card receiving portion or communication module 21. In the illustrated embodiment, the information card receiving portion 21 extends upwardly to a peak and downwardly transitioning into the display portion 22. It should be noted that the information card receiving portion could optionally include any type of communication module, such as an optical scanner, RF receiver/transmitter, RFID encoder/decoder, magnetic strip reader, smart card reader, etc.

Figure 2:
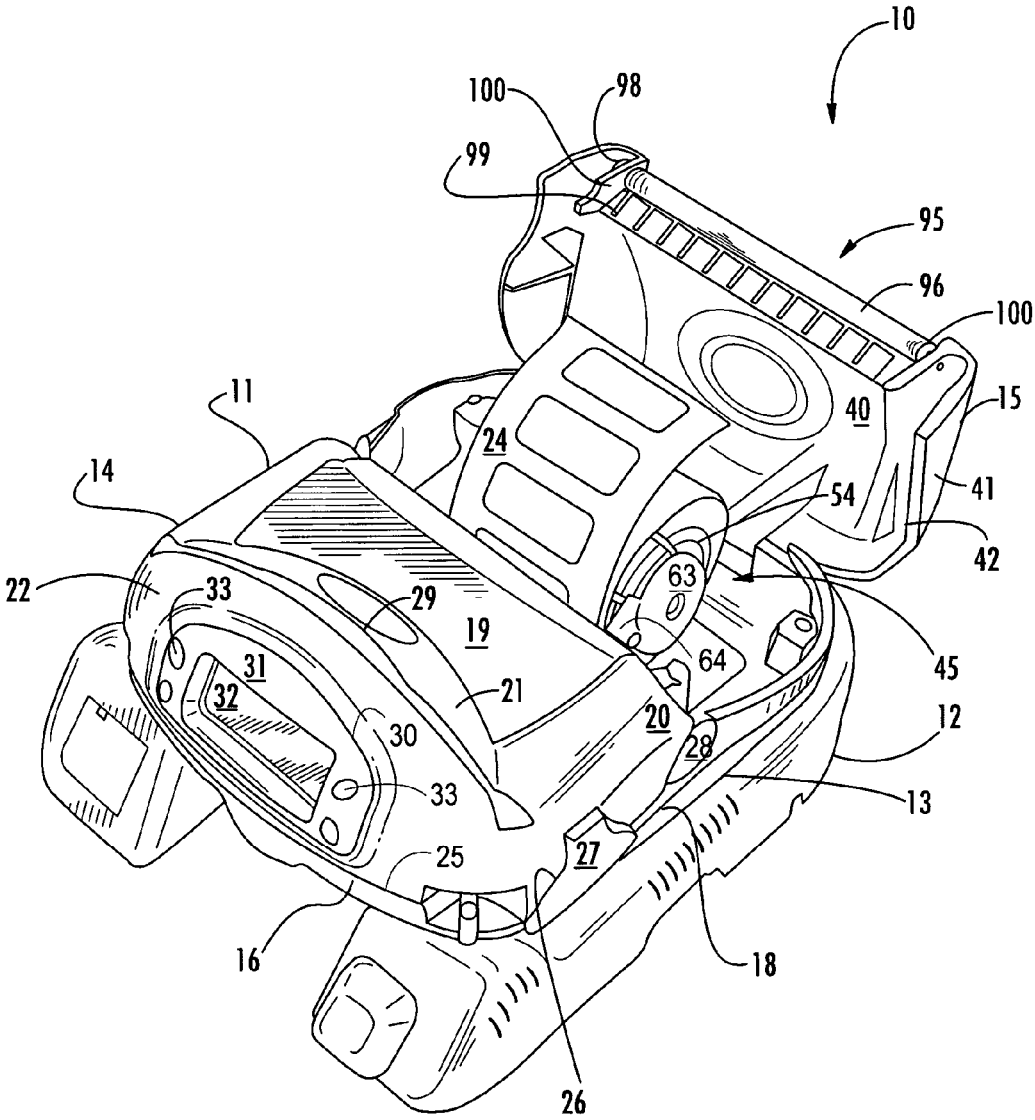
FIG. 2 is a perspective view of the printer of FIG. 1 with a media cover in an open position.

Defined at the peak of the information card receiving portion 21 is a card receiving slot 29 that is sized and shaped to allow a magnetic strip information card (such as a credit card) to be "swiped" therethrough for reading and decoding of information recorded thereon. Other types of information card could also be extended through the card receiving slot 29 for reading, including various bar-coded cards or contact and non-contact smart cards. Further, any media, such as envelope, slip of paper, etc., having a magnetic strip or smart card features could be slid and read via the slots. The display portion 22 of the card processor cover 14 defines a display opening 30 through which extends a display unit 31, as shown in FIGS. 1 and 2. The display unit 31 includes a display screen 32 and four buttons 33 that communicate information on operation of the printer 10 and record inputs and selections by the operator.

The media supply cover 15 includes its own deck portion 41 and wall structure 42, as shown in FIGS. 1 and 2. The deck portion 41 is a relatively flat, planar surface that is coextensive with the deck portion 19 of the wireless card processor cover 14. The deck portion 41 defines an edge of the media dispensing opening 23 opposite the edge defined by the deck portion 19 of the wireless card processor cover 14. Optionally, the deck portion may be constructed of a transparent or translucent material to facilitate visibility of the media roll in anticipation of replacement of a spent or nearly spent media roll. A free edge of the wall structure 42 is configured to mate with a portion of the free edge 25 of the sidewalls 20 of the wireless card processor cover 14 and a portion of the free edge 18 of the wall structure 16 of the base 13 to form the closed housing 11 shown in FIG. 1.

Now that the external aspects of the printer 10 of the illustrated embodiment have been described, including the structure of its housing 11, attention will be turned to the contents of the housing, including the various assemblies that enable the printing and card reading functions.

Figure 3:
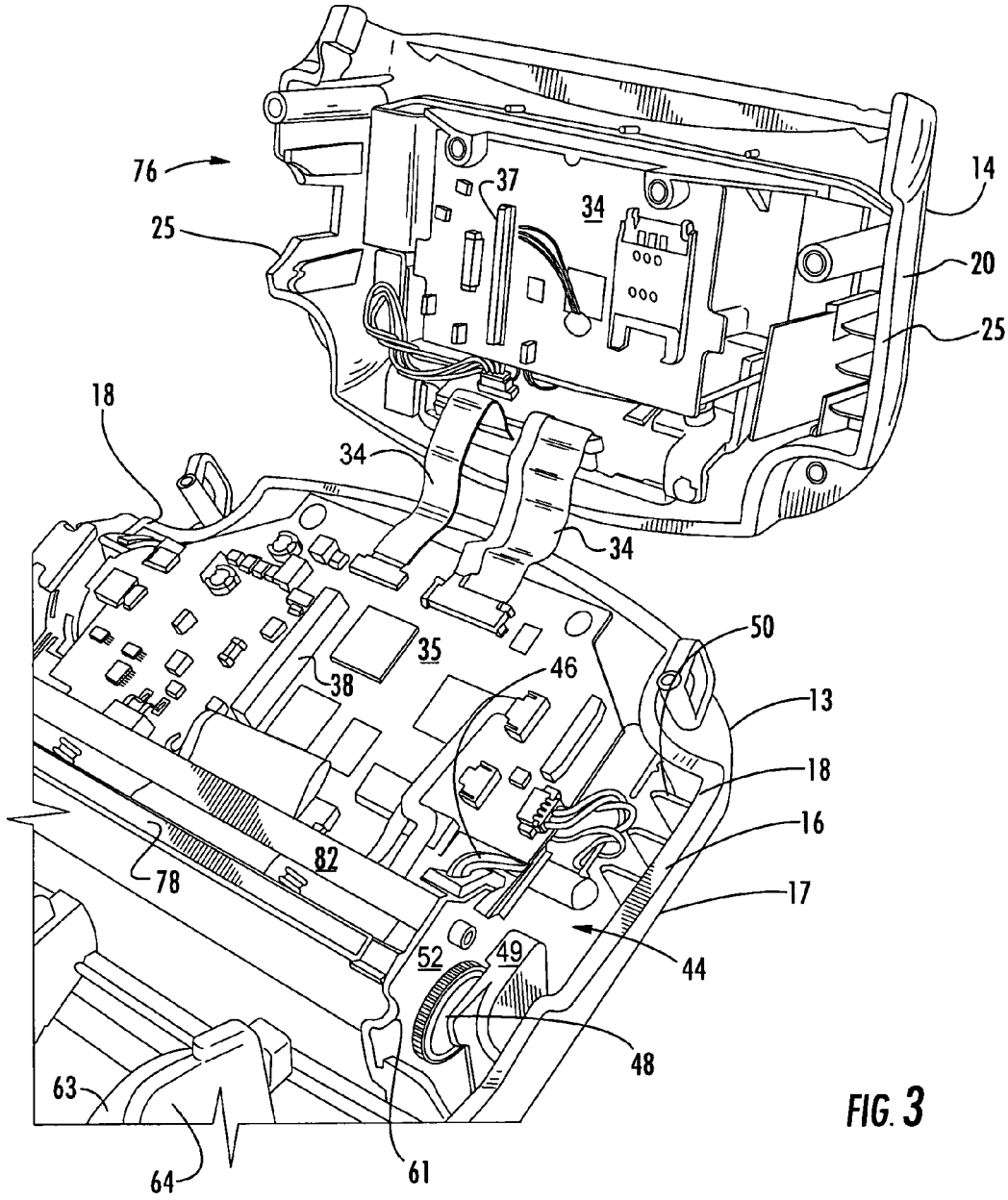
FIG. 3 is a perspective view of a wireless card processor cover and main circuit board of the printer of FIG. 1.

Supported by the wireless card processor cover 14 is a wireless communications and card processing circuit board 34, as shown in FIG. 3. The circuit board 34 is configured to perform communications tasks and includes, for example, one or more of a Wi-Fi 802.11 wireless interface, a Bluetooth wireless radio and a cellular network connection to promote wireless, handheld use. The wireless communications and card processing circuit board 34 is further configured to interface with a smartcard, magnetic card, barcode scanning or other information card reading device (not shown) supported in the wireless card processor cover 14 between the cover and the circuit board 34.

Generally, the wireless communications and card processing circuit board 34 obtains information from the card reading device, processes the data and routes it to a main circuit board 35. Supported on the wireless communications and card processing circuit board 34 is a multiple pin male connector 37 that is configured for insertion into a multiple pin female connector 38 on the main circuit board 35 when the housing 11 is assembled, thereby enabling the aforementioned communication between the two boards. The display unit 31 is also supported by the wireless card processor cover 14 and is connected to the main circuit board 35 by ribbon cables 39 allowing communication between the display unit and the main circuit board.

Hereagain the above description of the wireless card processor cover 14 is somewhat specific to a card reading module. In other embodiments, not shown, the module can be an optical scanner, RF receiver/transmitter, RFID tag encoder/decoder, etc., in which case different components in the module would be used to facilitate its use and communication with the main circuit board 35 of the base 12 described below.

Figure 4:
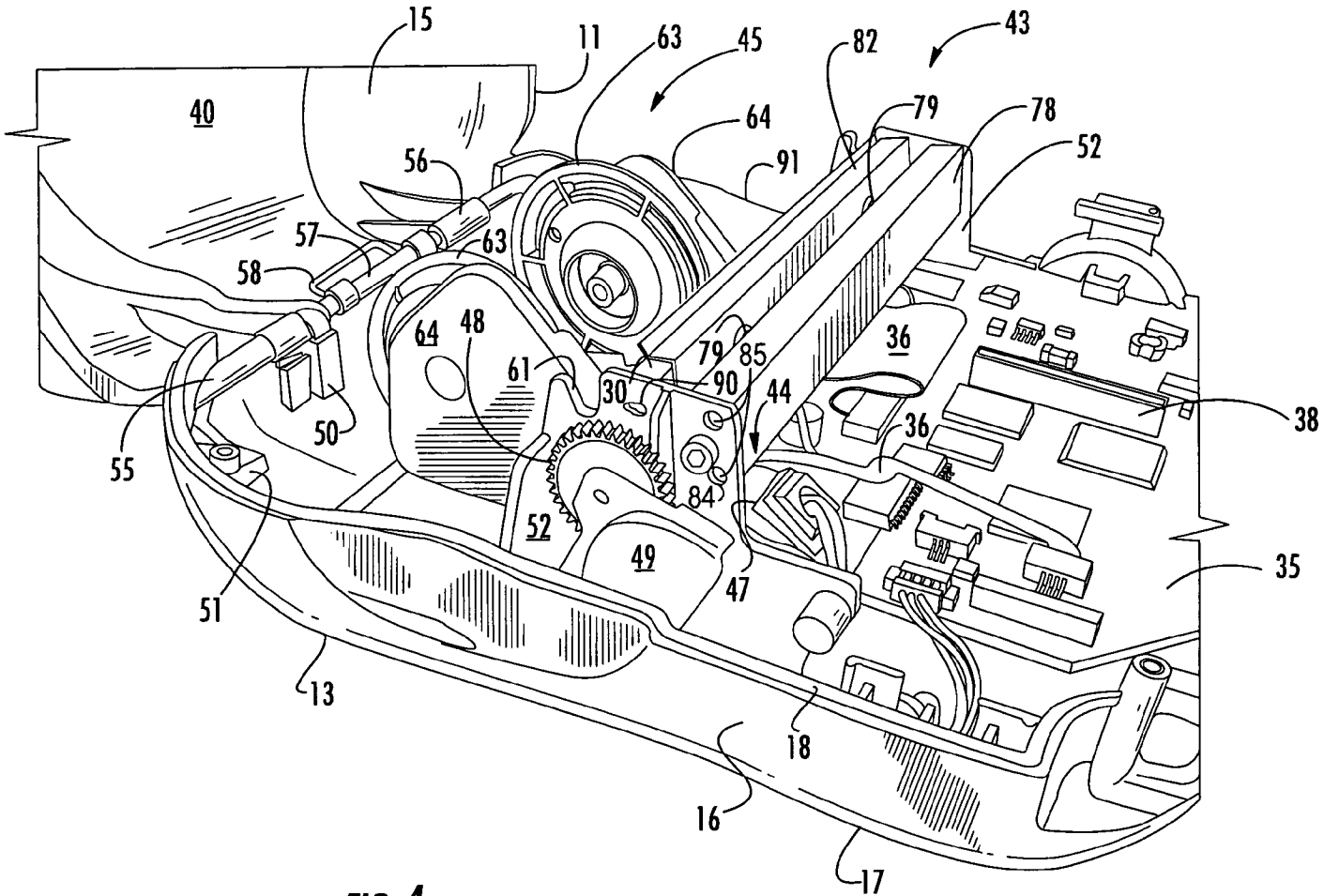
FIG. 4 is a perspective view of contents of a base portion of the printer of FIG. 1.
Figure 5:
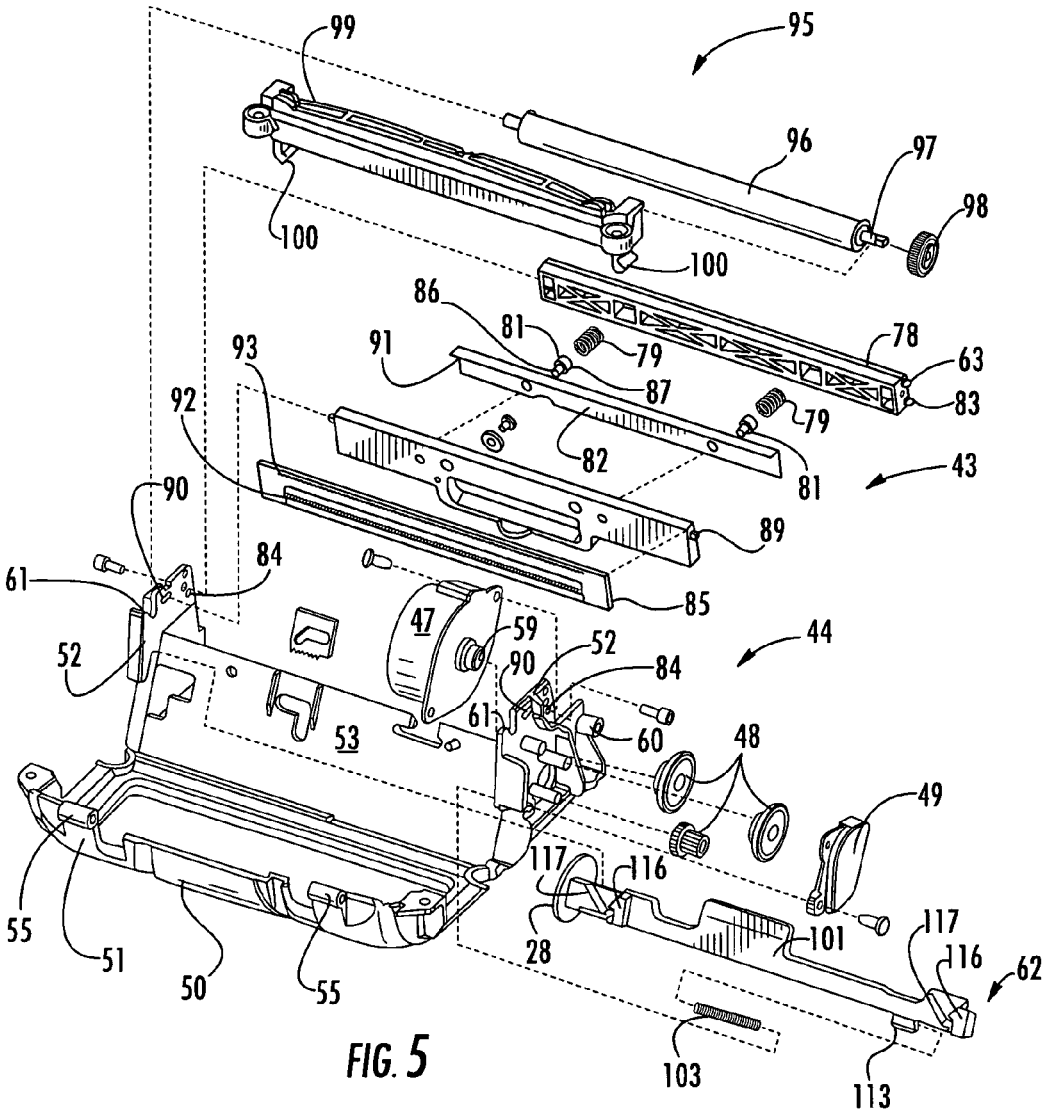
FIG. 5 is an exploded view of a print head, drive and latching assemblies of the printer of FIG. 1.

Referring now to FIG. 4, the base 13 of the housing 11 supports the main circuit board 35, a print head assembly 43, a drive assembly 44, a media support assembly 45 and a latch assembly 62. The print head assembly 43, the drive assembly 44, the media support assembly 45 and the latch assembly 62 are each mounted on a frame 50, as shown in FIGS. 4 and 5.

The frame 50 is supported within, and attached to, the base 13 of the housing 11. The frame 50 includes a hinge portion 51, and one or more side flanges 52 and a divider wall 53. The hinge portion 51 typically has a rectangular frame shape with rounded edges so as to fit in the rounded shape in an area of the base 13 housing a media supply roll 54. One or more hinge mounts 55 of the hinge portion 51 are positioned to extend along the free edge 18 of the base wall structure and to allow rotatable mounting of the media supply cover 15 at one edge via its own hinge mounts 56. A shaft 57 extends through the mounts 55, 56 and has mounted thereon a torsion spring 58 which biases the media supply cover 15 into its open position, as shown in FIG. 4.

It should be noted that the second stage opening device could also include other opening mechanisms such as a solenoid, pneumatics, hydraulics or other biasing devices and still fall within the purview of the present invention. The illustrated torsion spring, however, does have the advantage of a light weight and relatively low cost, especially since it is assisted in its first, or initial stage of opening by the latching mechanism.

The side flanges 52 of the frame 50 extend upwards from the base 13 of the housing 11 on the lateral sides of the base. The divider wall 53 extends between the side flanges 52 and generally partitions the base 13 into two portions, one portion having the media support assembly 45 and the other portion containing the main circuit board 35. Both the flanges 52 and the divider wall 53 have structure that provides support for the assemblies 43, 44 and 45, as will be described in more detail below with the description of the assemblies.

The main circuit board 35 includes a processor and other electronic components for controlling printer operation which are not described in greater detail herein for the sake of brevity. A pigtail wire 46 connects the main circuit board 35 to the drive assembly 44 and ribbon cables 36 connect the main circuit board to the print head assembly 43. As mentioned above, the ribbon cables 39 connect the display unit 31 to the main circuit board. These connections enable the main circuit board 35 to communicate with, and control, the print head and drive assemblies 43, 44.

The drive assembly 44 includes a motor 47, several drive gears 48 and a gear cover 49, as shown in FIGS. 4 and 5. The motor 47 is mounted to the inside surface of one of the side flanges 52 and has a drive shaft 59 extending through an opening in the side flange to mesh with the drive gears 48. The drive gears are rotatably mounted on pegs 60 extending from the opposite side of the side flange, and mesh with each other so as to be driven by the motor 47. The gear cover 49 is mounted over a portion of the drive gears 48 so as to protect the drive gears during operation.

Figure 6:
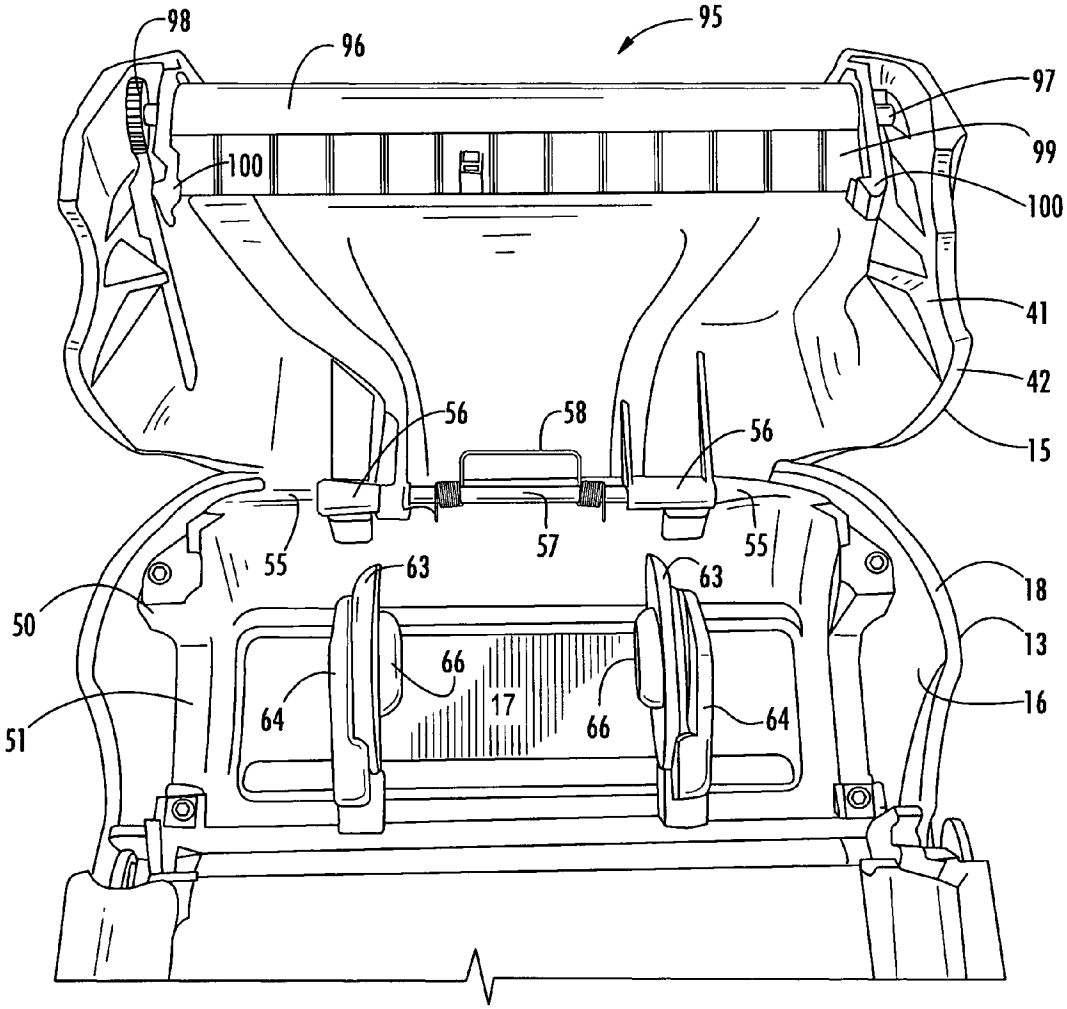
FIG. 6 is a perspective view of a media support assembly of the printer of FIG. 1.
Figure 7:
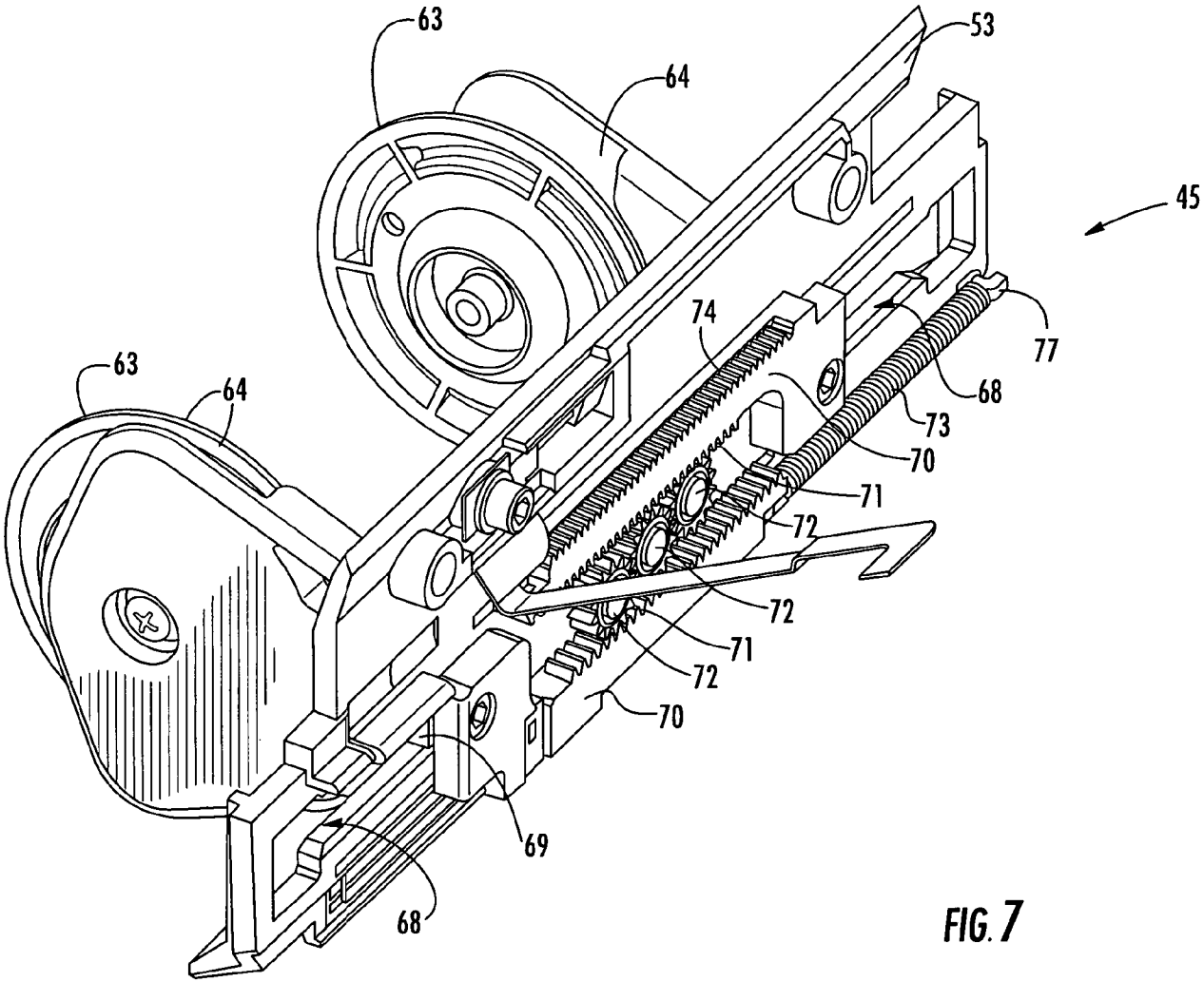
FIG. 7 is a perspective view of the media support assembly of FIG. 6.
Figure 8:
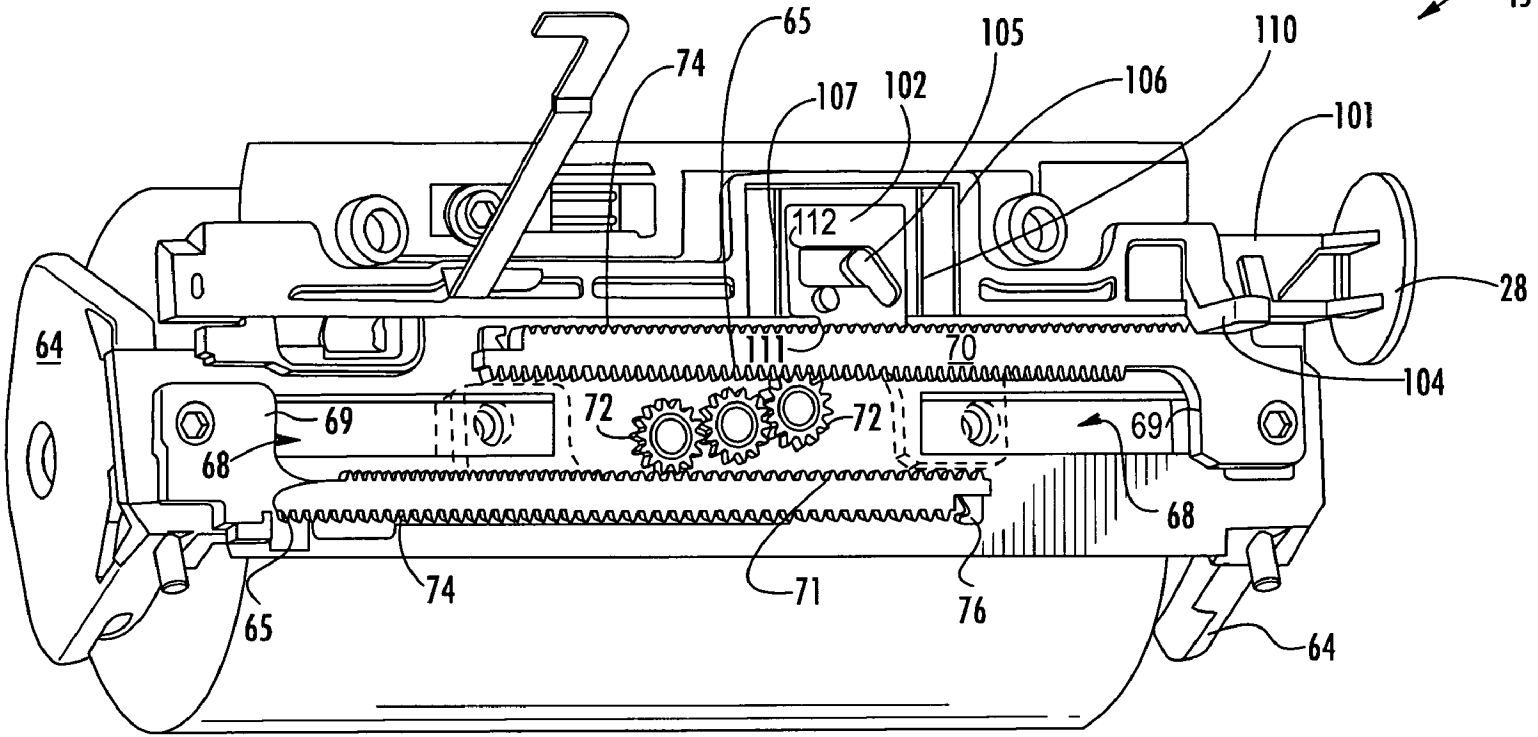
FIG. 8 is another perspective view of the media support assembly of FIG. 6 containing a roll of media.
Figure 9:
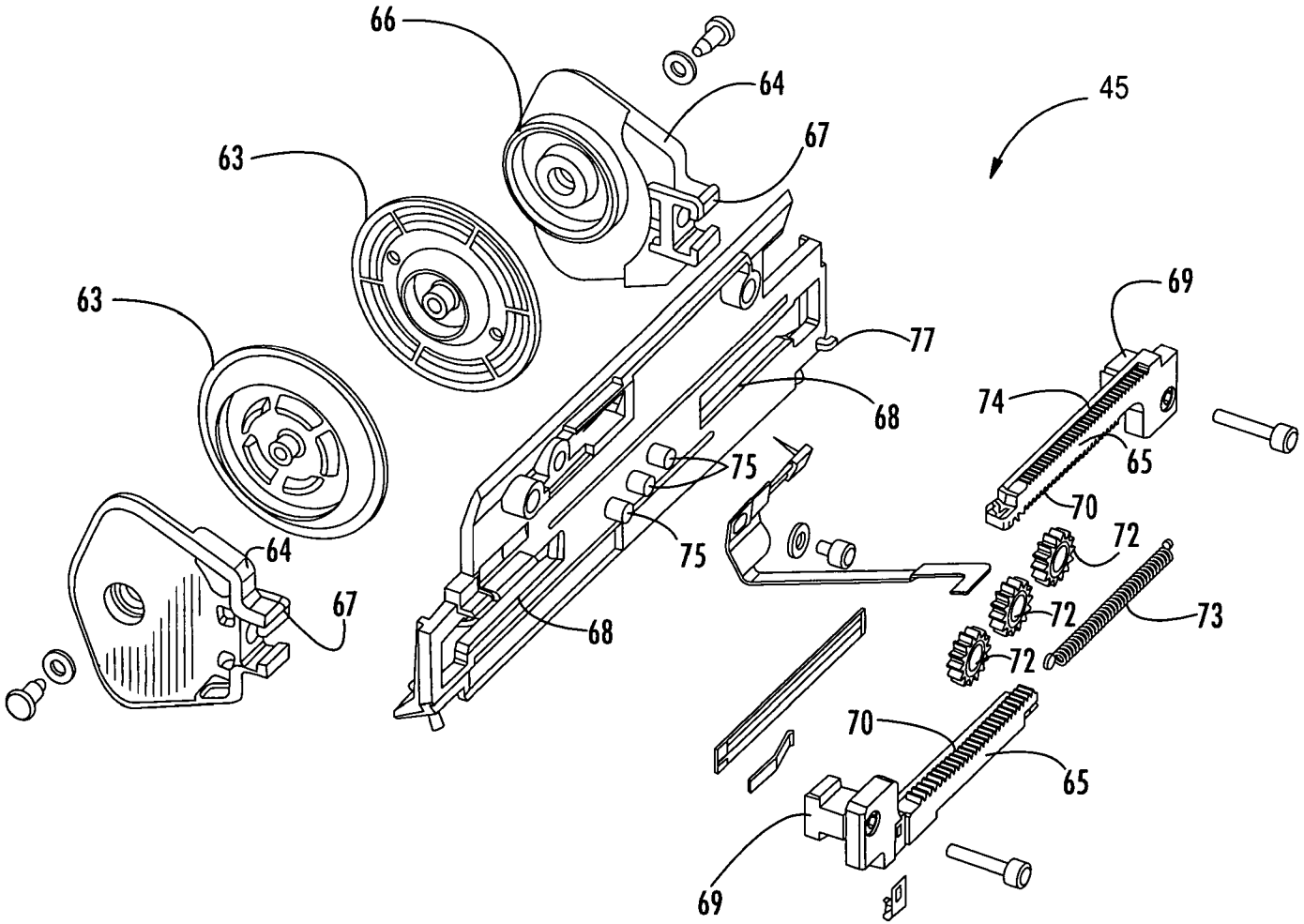
FIG. 9 is an exploded view of the media support assembly of FIG. 6.

In one embodiment of the present invention, the media support assembly 45 includes a pair of media support discs 63, a pair of disc support flanges 64, a pair of racks 65, two or more pinions 72 and a tension spring 73, as shown in FIGS. 6-9. Each of the media support discs 63 has circular outer edges and a centrally located raised circular portion configured to grip an end of the media supply roll 54, as shown in FIG. 6. The media support discs 63 are supported by the disc support flanges 64 in opposing positions so as to be able to grip the media supply roll 54 when positioned between the media support discs. As shown in FIG. 9, each of the disc support flanges has a circular mounting 66 configured to allow free rotation of the media support discs 63. In addition, each of the disc support flanges 64 also includes a mount 67 that has an internal channel shape that is configured to mate with a T-shaped mounting 69 (which can also be considered to be a portion of the rack arms) fixed to a respective one of the racks 65.

Addition description of media centering devices are described in commonly assigned U.S. patent application Ser. No. 10/350,970 entitled "Print Media Guide System" filed on Jan. 23, 2003; U.S. Provisional Patent Application No. 60/351,813 filed on Jan. 25, 2002; and U.S. patent application Ser. No. 10/901,883 entitled "Printer Assembly and Method of Using the Same" filed on Jul. 29, 2004, all of which are hereby incorporated herein by reference.

The T-shaped mounting 69 of each of the racks 65 is also configured to fit and slide within a respective one of a pair of guide slots 68 defined by the divider wall 53, as shown in FIGS. 7 and 8. Extending from the T-shaped mounting 69 is a rack arm 70 that has a pinion surface or face 71 that has teeth shaped to mesh with the teeth of one of the pinions 72. The rack arm 70 also includes a locking face 74 positioned opposite the pinion face 71 for interacting with the latch assembly 62 to lock the rack arm in place, as will be described in more detail below.

One rack arm 70 occupies a lower position below the pinions 72 and extends in an opposite direction from the other rack arm which is positioned above the pinions. The pinions 72 are each rotatably mounted on pinion pegs 75 (shown in FIG. 9) extending outwardly from the divider wall 53 and communicate sliding motion between the rack arm 70 of each of racks 65. Each of the racks 65 also includes a spring hook 76 formed at an end opposite the T-shaped mounting 69. Attached to the spring hook 76 of one, or both, of the racks 65 is the tension spring 73 that extends therefrom to an attachment hook 77 formed on the divider wall 53.

The tension spring 73 biases the disc support flanges 64 and media support discs 63 together by exerting tension directly on its one of the racks 65, and indirectly on the other one of the racks through the pinions 72. As shown in FIG. 7, the length of the guide slots of 53 acts as a stop against the racks 65 running into each other and limits the travel of the media support discs 63. This facilitates one-handed insertion of the media supply roll 54 by allowing enough space for the roll to be inserted between the media support discs 63. An additional tension spring 73 may be used, so that both of the racks 65 are directly, and indirectly, biased together.

The positioning of the pinions 72 of the media support assembly 45 in FIGS. 7 and 8 illustrates another embodiment of the present invention. In particular, the outer two of the pinions 72 are positioned off of a center point, line or vertical plane defined midway between the media support discs 63 or flanges 64, which due to the coupled, mirror image movement of the discs and flanges, is a center point of the media supply roll 54. Such off center positioning of the outer pinions 72, and/or their respective instantaneous contact or engagement areas with the racks 65, advantageously provides room for components that extend into the center area. In addition, the use of multiple pinions guards against malfunction of the assembly 45 during a drop or other impact.

Without being wed to theory, it appears that the increase in contact area from using multiple pinions 72 serves to increase stability. In addition, the spaced apart contact areas are closer to the engagement of the T-shaped mountings with the guide slots 68, possibly decreasing the chance for deflection of the rack arm 70. Additional stability of the media support assembly 45 may also be due to the similar diameter and size of the three pinions 72. Regardless, as will be described in greater detail below, the use multiple pinions with spaced, off-center engagement surfaces, or other movable engagement members that couple movement of the media support discs 63 or flanges 64, provides several advantages and can be accomplished through various embodiments.

Figure 10:
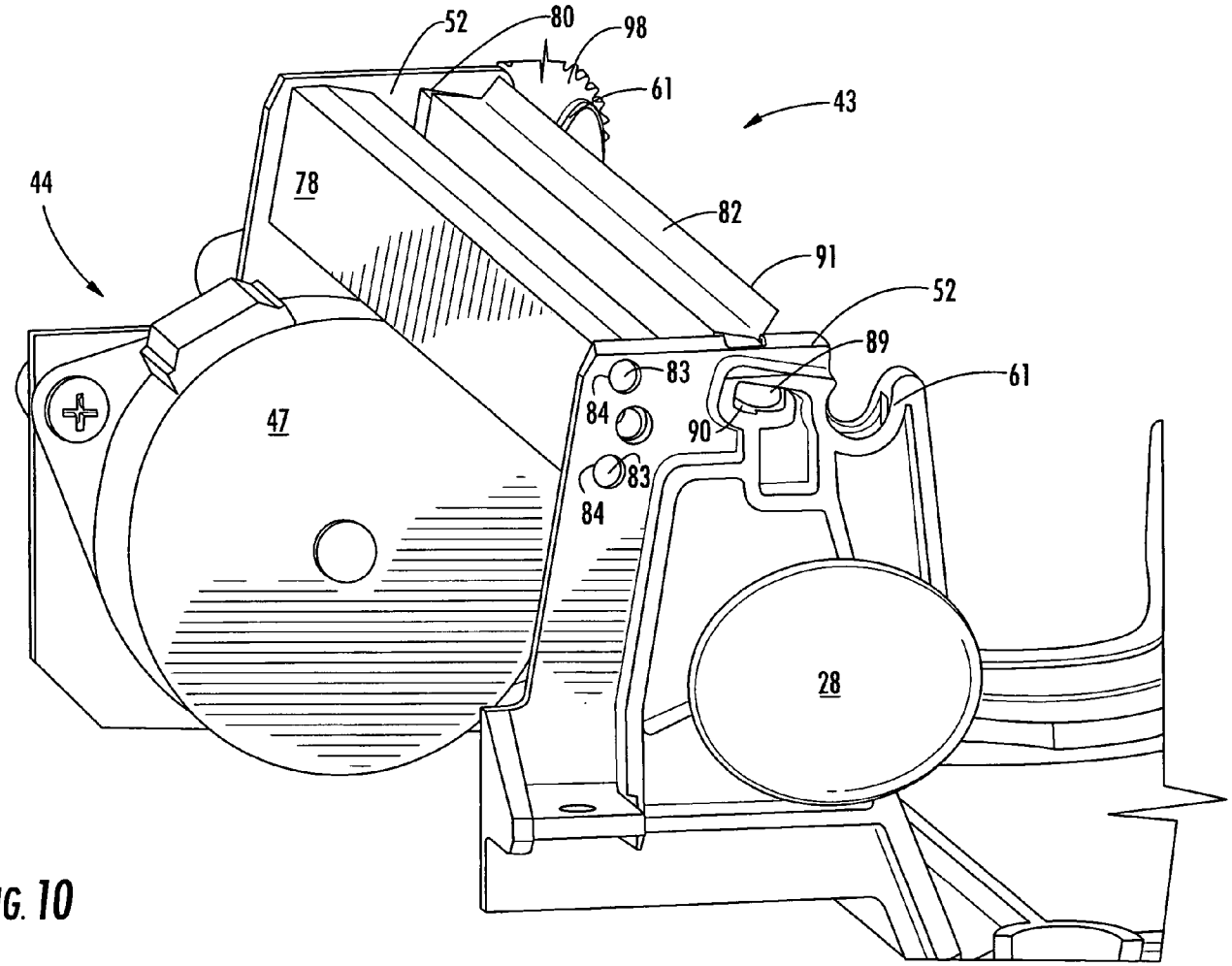
FIG. 10 is a perspective view of the print head assembly of FIG. 5.

The print head assembly 43 includes a mounting bar 78, one or more springs 79, a heat sink 80, one or more stop screws, bolts or pegs 81, a tear bar 82 and a thermal printing interface 85, as shown in FIG. 5. The mounting bar 78 has an elongate rectangular shape and includes a pair of mounting pegs 83 on its ends. Cutouts in the mounting bar 78 reduce its weight and the elongate shape allows mounting of the mounting bar between the pair of side flanges 52. In particular, each of the side flanges 52 defines a pair of mounting openings 84 sized and positioned to receive the mounting pegs 83 on the ends of the mounting bar 78, as shown in FIG. 10.

Figure 11:
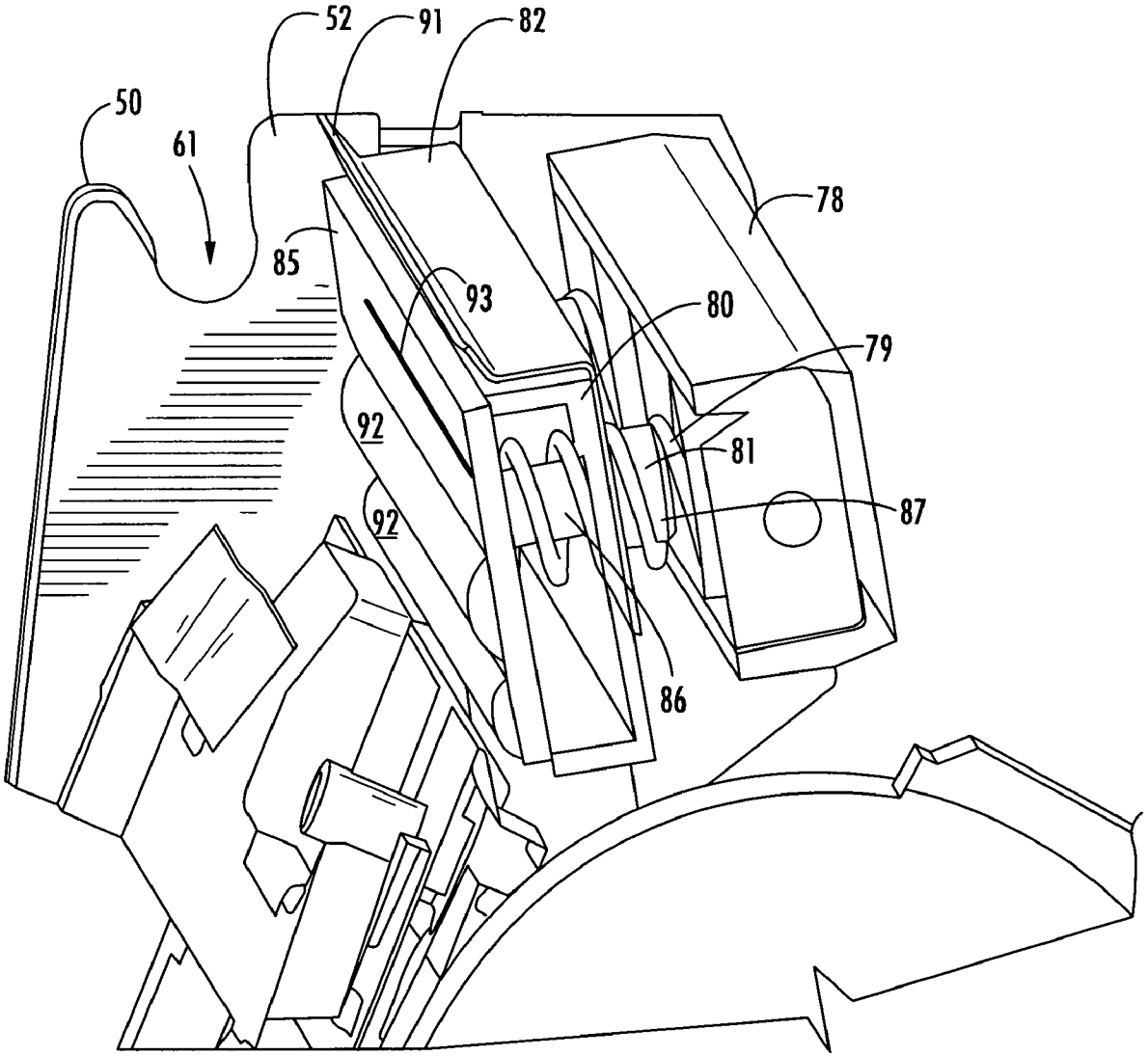
FIG. 11 is a sectional view of the print head assembly of FIG. 5.

The springs 79 are attached at one end to the mounting bar 78 at spaced positions. The springs 79 are coil springs that extend toward the media support assembly 45, pass through openings in the heat sink 80 and attach at their other ends to the thermal printing interface 85. Extending within the springs 79 are the stop pegs 81, each of which includes a shaft 86 and a head 87. The shaft 86 of each of the stop pegs 81 attaches to the thermal printing interface 85 and extends through the heat sink 80 to the head 87. The head is positioned between the heat sink 80 and the mounting bar 78, as shown in FIG. 11.

Similar to the mounting bar 78, the heat sink 80 has an elongate rectangular shape that extends between the side flanges 52. Also, the heat sink 80 includes one of a pair of elliptical mounting pegs 89 at each of its ends. Defined in the side flanges 52 are slots 90 sized to receive a minor width of each of the elliptical mounting pegs 89. The length of the slots 90 allow sliding of the elliptical mounting pegs 89 therein. Attached to the heat sink 80 and extending therealong are the tear bar 82 and the thermal printing interface 85.

The tear bar 82 is constructed of a sheet of metal bent to conform to an upper corner of the heat sink 80, and includes a serrated tearing edge 91 flared upwards from the upper surface of the heat sink and over an upper edge of the thermal printing interface 85. The thermal printing interface 85 is attached to the heat sink 80 on the side of the media support assembly 45. On its outward surface facing the media support assembly, the thermal printing interface 85 includes a pair of arcuate rider surfaces 92 and a burn line 93. The rider surfaces 92 extend in parallel along the length of the thermal printing interface 85 below the burn line 93 which also extends along the length of the thermal printing interface.

A platen assembly 95 of the printer 10 is shown in FIGS. 5 and 6, and includes a platen bar 96, a platen shaft 97 and a platen gear 98 and is supported by a platen frame 99 of the media supply cover 15. In the illustrated embodiment, the platen bar 96 is an elongate, cylindrical bar that includes a rubber or polymeric coating to facilitate gripping of the strip of media 24. The platen bar 96 extends between a pair of spaced flanges 100 defined on opposite sides of the platen frame 99 near the wall structure 42 of the media supply cover 15. The platen shaft 97 extends from the ends of the platen bar 96 and through corresponding openings defined in the flanges 100 so as to rotatably support the platen bar and shaft. On one end, the platen shaft 97 supports the platen gear 98, which is recessed between the adjacent one of the flanges 100 and the wall structure 42, as shown in FIG. 6.

Preferably, the platen bar 96, platen shaft 97 and platen gear 98 are integrally constructed by being machined from a single piece of relatively rigid metal, such as steel or aluminum. Advantageously, integral construction ensures that the platen gear maintains its orientation during operation, even after the printer 10 has been jarred by a drop or other blow. In addition, use of metal allows the gear to withstand the heat of application of the rubber or polymeric coating on the outer surface of the platen bar 96.

Figure 14:
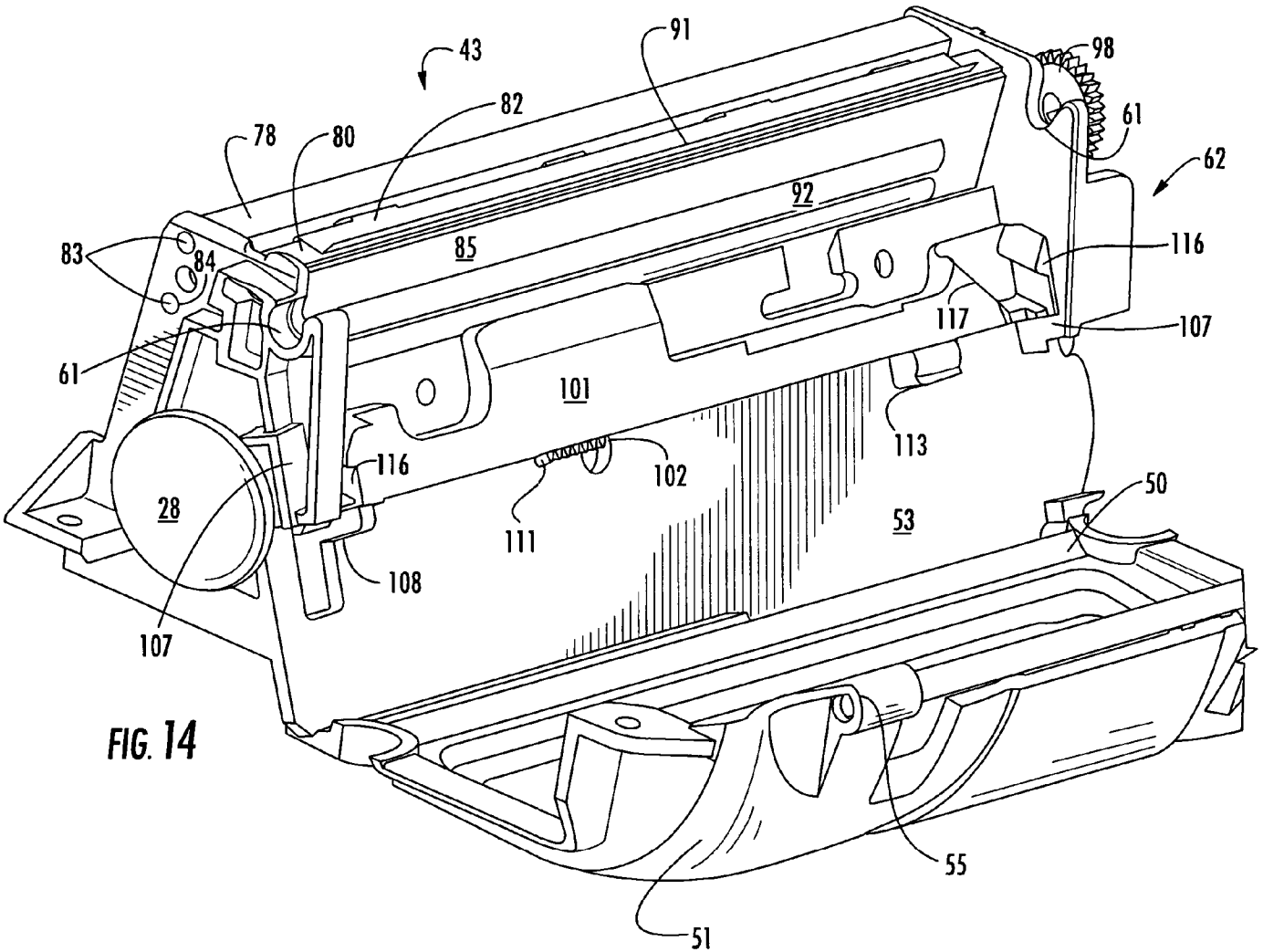
FIG. 14 is a perspective view of the print head assembly of FIG. 5 and the latch assembly of FIG. 13.

The side flanges 52 of the frame 50 define a pair of journal notches 61 that have a circular inner portion and a flared outer portion, as shown in FIGS. 11 and 14. The journal notches 61 are sized and shaped to receive ends of the platen shaft 97 when the media supply cover 15 is in a closed position.

When the media supply cover 15 is in the closed position, the platen assembly 95 cooperates with the drive assembly 44 and the media support assembly 45 to draw the strip of media 24 across the thermal printing interface 85 of the print head assembly 43 for printing. In particular, when the media supply cover 15 is closed, the platen bar 96 is positioned against the burn line 93 of the thermal printing interface 85 and the platen gear 98 meshes with the top-most one of the drive gears 48. The strip of media 24 extends over the rider surfaces 92 and between the platen bar 96 and the burn line 93. The thermal printing interface 85 is urged against the strip of media 24 and the platen bar 96 by the springs 79.

Advantageously, the thermal printing interface 85 can also shift to compensate for varying thicknesses of the strip of media 24 because of the elliptical mounting pegs 89 on the ends of the supporting heat sink 80 which can slide within the slots 90. This shifting motion is limited, or mediated, by the size of the slots 90 if the forces on the heat sink 80, tear bar 82 and thermal printing interface 85 are large, such as when the strip of media 24 is torn over the tear bar after printing. Optionally, the shifting motion may be limited also by the step pegs 81 dead-ending against the mounting bar 78. Engagement of the platen gear 98 with the drive gears 48 allows the motor 47 to turn the platen bar 96. The compression provided by the springs 79 and the friction of the gripping surface of the platen bar 96 enable the motion of the platen bar to pull the strip of media 24 off of the media supply roll 54.

Figure 13:
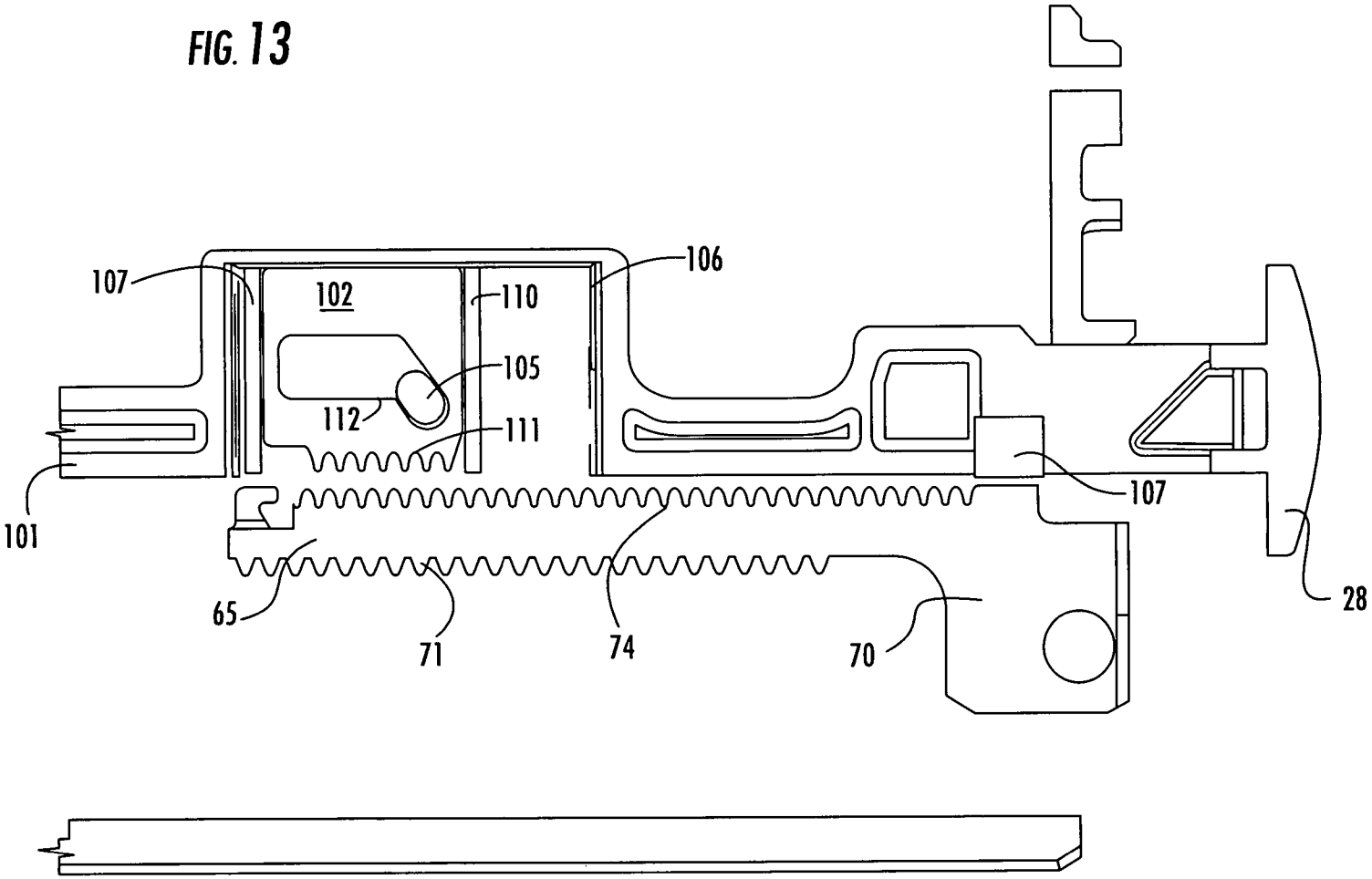
FIG. 13 is a partial view of a latch assembly of the printer of FIG. 1.

The latch assembly 62 includes a latch member 101, a locking plate 102 and a latch spring 103, as shown in FIG. 5. The latch member 101 has an elongate shape with the latch button 28 extending from one end. The latch member is slidably supported channels 107 that are defined in the side flanges 52 of the frame 50, as shown in FIGS. 13 and 14.

Figure 12:
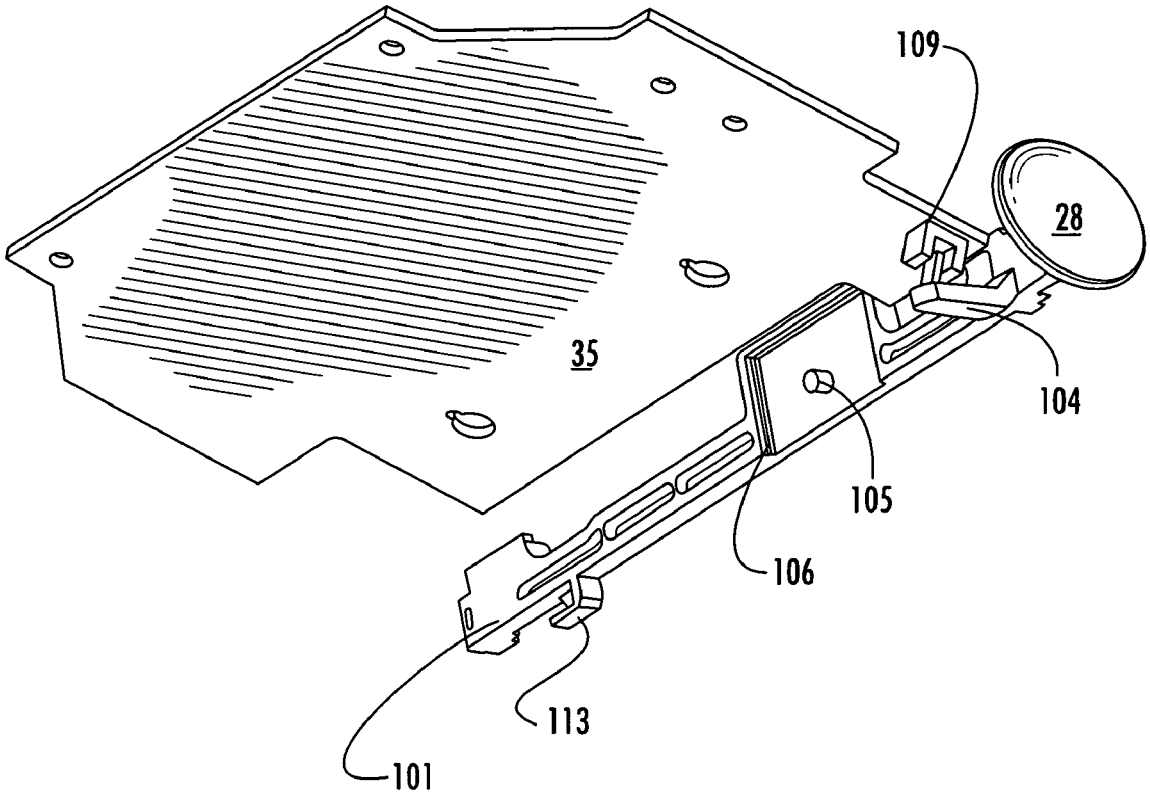
FIG. 12 is a perspective view of an interrupt sensor mounted on the main circuit board and a latch member of the printer of FIG. 1.

On a side of the latch member 101 facing the divider wall 53, the latch member includes a sensor arm 104 and a tracking peg 105 that is positioned in a rectangular recess 106, as shown in FIG. 12. The sensor arm 104 is positioned at one end of the latch member 101 and extends down through a sensor arm opening 108 defined in the divider wall 53 and upward into a U-shaped interrupt sensor 109. The U-shaped interrupt sensor is preferably an optical sensor that is supported by the main circuit board 35 and communicates interruption when the sensor arm is positioned in the arms of the sensor.

The rectangular recess 106 is sized to extend around a pair of vertically oriented locking plate guides 110 that extend outward from the divider wall 53, as shown in FIG. 5. The locking plate guides 110 are parallel and spaced apart from each other about the same distance as the width of the locking plate 102, as shown in FIG. 13. The locking plate 102 has a thin, rectangular shape and includes a row of teeth 111 extending along one edge. An engagement opening 112 defined in the locking plate includes an angled portion and a straight portion and is sized to extend around the tracking peg 105. The tracking peg extends outward from the base of the rectangular recess 106 and has an elongate shape with rounded ends that is sized to slide within the engagement opening 112.

As assembled, the latch member 101 extends closely along the divider wall 53 and the rectangular recess 106 is positioned over the locking plate guides 110. The locking plate 102 extends between the locking plate guides and the tracking peg 105 extends into the engagement opening 112. The shape of the engagement opening causes the teeth 111 of the locking plate 102 to be urged into and out of engagement with teeth on the locking face 74 of the adjacent rack arm 70. In particular, sliding of the latch member 101 (by depressing of latch button 28) moves the tracking peg 105 within the engagement opening 112 from the angled portion (as shown in FIG. 13) to the straight portion.

In the angled portion of the engagement opening, the locking plate 102 is positioned at the top of the locking plate guides 110 and adjacent the edge of the rectangular recess 106. In the straight portion, the locking plate is positioned at the bottom of the locking plate guides 110 and the teeth 111 of the locking plate 102 engage the teeth of the locking face 74. Notably, the teeth 111 of the locking plate 102 have a concavely curved shape so that they easily capture and urge themselves into firm engagement with the convexly curved shape of the teeth of the locking face, as shown in FIG. 8. It should be noted that the concavity and convexity of the teeth could be reversed and accomplish the same objective of a firm, positive fit.

Referring again to FIG. 12, the latch member 101 includes a spring flange 113 for engaging the latch spring 103. The latch spring is preferably a compression spring and is positioned between the spring flange 113 and the adjacent one of the side flanges 52 so that the latch member is biased to urge the button 28 outwards, i.e., in the left-handed direction on FIG. 5. Engagement of the latch member with the flanges 100 when the media supply cover is closed, as will be described in more detail below, holds the latch member short of its left-most position wherein the locking plate 102 is biased toward the engaged or locking position. In this position, the locking plate 102 inhibits movement of the racks 65 which, in turn, locks the media support discs 63 about the media supply roll 54. Opening of the lid 15 disengages the flanges 100 and the latch member 101, allowing the latch member to be biased to the outermost position, which disengages the locking plate 102 from the locking face 74.

Advantageously, engaging the rack arm 70 instead of engaging one of the pinions 72 allows for a compact locking mechanism because the rack arm can be locked external to the interface between the pinion face 71 and the pinions 72. Compactness of the locking mechanism is also derived from the positioning of the locking face 74 opposite the pinion face 71 and the recessed positioning of the locking plate 102 within the latch member 101. In addition, the direct engagement of the rack arm 70 by the locking plate 102 (as opposed to some type of engagement of one of the pinions 72) reduces complexity of the mechanism for robust performance.

It should be noted that the locking face 74 and the locking plate 102 could have interfaces other than teeth to allow for releasable engagement, such as adhesives, magnets or hook and loop connections. Also, it should be noted that the locking plate 102 could be positioned to engage a lateral, or other, surface of the of the rack arm 70. In addition, the locking plate 102 could engage the rack arm of the lower one of the racks 65. Further, the row of teeth 111 could be positioned on various shapes and sizes of members in lieu of the locking plate, that are cam activated by motion of the latch member 101, or even be supported directly on the latch member. For instance, the latch member may itself have cam surfaces so that it moves into and out of contact with the locking face 74 along with motion used to unlatch the media supply cover 15, and still be within the purview of the present invention.

Figure 15:
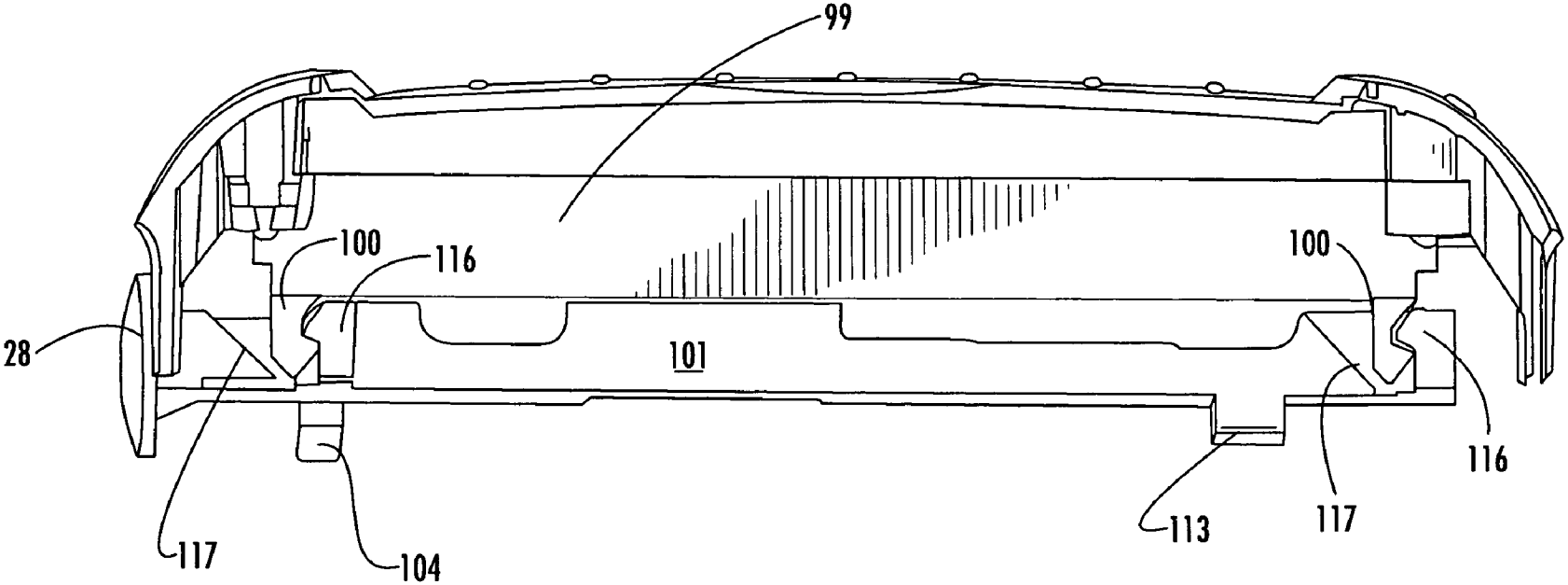
FIG. 15 is an elevation view of the latch member of FIG. 12.

In addition to locking and unlocking the media support assembly 45, the latch assembly is configured to enable one-handed opening of the media supply cover 15. As shown in FIG. 15, the side of the latch member 101 facing the media support assembly 45 includes a pair of catch hooks 116 and a pair of outwardly sloped cam surfaces 117. The catch hooks 116 are configured to engage the similarly shaped flanges 100 on the platen frame 99 and, under the bias from the latch spring 103, hold the cover shut until the bias from the latch spring is overcome by depressing the latch button 28.

The outwardly sloped cam surfaces 117 are positioned to engage and urge the similarly sloped back sides of the flanges 100 on the platen frame 99 in an upward direction. Such urging helps to overcome bias against opening of the media supply cover 15, such as the weight of the platen assembly 95 and the media supply cover and friction between the biased thermal printing interface 85 and the rubber coated platen bar 96. In addition, the urging of the outwardly sloped cam surfaces 117 may be aided by the springs 79 of the print head assembly 43 urging the thermal printing interface 85 against the platen bar 96.

Opening is also inhibited somewhat by the shape of the journal notches 61 defined by the side flanges 52 of the frame 50. In particular, the intersection between the circular inner portion and flared outer portion of the journal notches 61 forms a shoulder that inhibits movement of the platen shaft 97 somewhat from the circular inner portion to the flared outer portion during opening of the media supply cover 15, as shown in FIG. 11. In addition, as the media supply cover 15 moves upwardly its motion is aided by the torsion spring 58 which has a sufficient bias to complete movement of the media supply cover into the open position after opening is initiated, as shown in FIGS. 2 and 6.

It should be noted that other shapes of cam surfaces 117 could be used to urge the media supply cover 15 upwards, and includes various surfaces with outwardly directed components. For instance, various sloped and curved shapes could be used in lieu of the linear ramp shape of the of the outwardly sloped cam surfaces 117 of the illustrated embodiment. As another alternative, the latch member 101 could be combined with other biasing devices that are activated after unlatching and provide an initial bias to the media supply cover 15. For instance, the latch member 101 could include its own compression spring that is released upon movement of the latch member to the unlatched position. Generally therefore, the present invention includes biasing of the media supply cover 15 combined with unlatching to facilitate one handed opening of the media supply cover.

During replacement of the media supply roll 54, the user pushes the latch button, 28 against the bias of the latch spring 103, which slides the latch member 101 inward and disengages the catch hooks 116 from the flanges 100 on the platen frame 99 supported by the media supply cover 15. At this point, the supply cover 15 is no longer locked down, but the torsion spring 58 provides insufficient bias to urge the media supply cover upwards against its own weight and the friction between the rubberized coating on the platen bar 96 and the thermal printing interface 85. At the same time, the tracking peg 105 is sliding along the straight portion of the engagement opening 112, as shown in FIG. 8.

After the catch hooks 116 have been disengaged, further compression of the latch button 28 engages the outwardly sloped cam surfaces 117 with the back sides of the flanges 100. As the flanges extend upward along the cam surfaces 117, the media supply cover 15 is urged upward, until the platen bar 96 is off of the thermal printing interface 85. Due at first to the bias of the torsion spring 58 and the bias from the cam surfaces 117, and eventually just the bias of the torsion spring when the media supply cover 15 has moved out of range of the latch member 101, the media supply cover 15 swings into the open position, as shown in FIG. 2.

At about the same time, the tracking peg 105 moves into the angled portion of the engagement opening 112 and urges the locking plate 102 upwards between the locking plate guides 110, thereby disengaging the locking plate teeth 111 from the teeth on the locking face 74 of the adjacent rack arm 70, as shown in FIG. 13. Disengagement of the teeth 74, 111 allows relative motion between the racks 65. The user can then reach in and retrieve the empty media supply roll 54. As the media supply roll is pulled the media support discs 63, disc support flanges 64 and the racks 65 are pushed apart against the bias exerted by the tension spring 73, allowing removal of the media supply roll with a single hand.

Placement of the new media supply roll 54 includes inserting the media supply roll between the media support discs 63 with one hand, pushing the media support discs apart against the tension spring 73. During insertion, the media support discs 63 remain centered (but could also right or left justify, or not justify at all, the media roll) due to the rotation of the pinions 72 which ensures coupling of the sliding motion of the racks 65. Once the ends of the media supply roll 54 are mounted within the edges of the media support discs 63, the user uses the same hand to push the media supply cover 15 closed against the bias of the torsion spring 58. Once the media supply cover 15 is nearly closed, the platen bar 96 pushes the thermal printing interface 85 back against the springs 79. As this occurs, the ends of the flanges 100 on the platen frame 99 intersect the tops of the catch hooks 116, sliding the latch member 101 against its bias from the latch spring 103 back into the configuration shown in FIG. 15.

Sliding of the latch member 101 also moves the tracking peg 105 from the angled portion of the engagement opening 112 in the locking plate 102, as shown in FIG. 13, into the straight portion of the engagement opening, as shown in FIG. 8. Movement into the straight portion causes the locking plate to slide within the locking plate guides 110 until the teeth 111 on the locking plate engage the teeth on the locking face 74 of the rack arm 70, thereby locking the racks 65 and the media support discs 63 in place.

Figure 16:
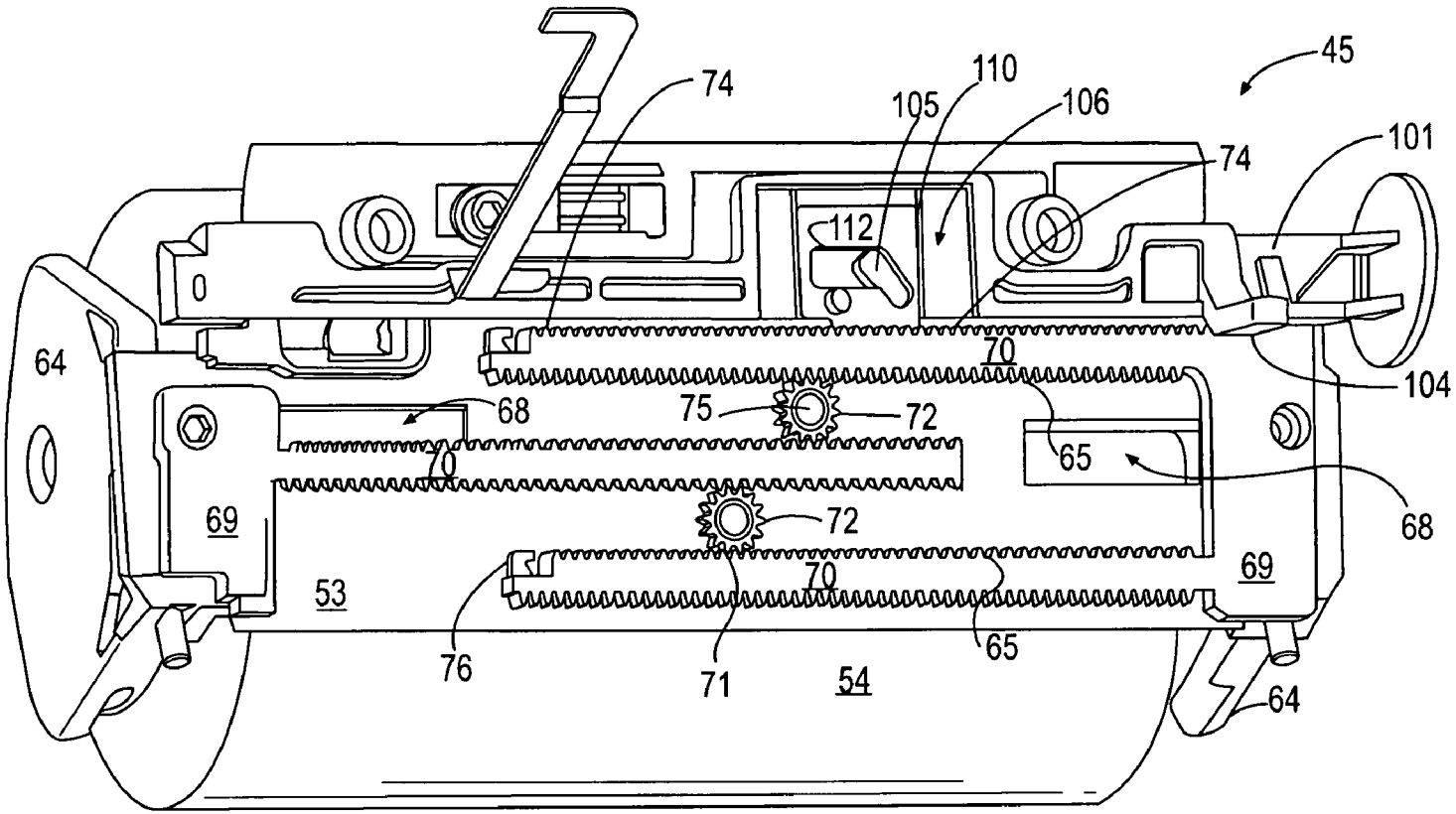
FIG. 16 is a perspective view of a media support assembly of another embodiment of the present invention having a media centering assembly with two pinions and three media support arms.

Referring back to the discussion above of the off center positioning of the interface between the movement coupling members (e.g., the pinions 72) and media support members (e.g., rack arms 70 and the discs 63 or flanges 64), the present invention includes several other exemplary embodiments of movement coupling devices that aid in centering the media supply roll 54. For example, as shown in FIG. 16, the T-shaped mounting 69 may be extended across the adjacent one of the guide slots 68 to support another (second) rack arm 70 that extends toward, and parallel to, the opposing rack arm 70. As a result, two rack arms extend in a U-shape from near the ends of the shared mounting 69 and the remaining rack arm 70 extends from a central portion of its mounting 69 between the other two rack arms.

Figure 17:
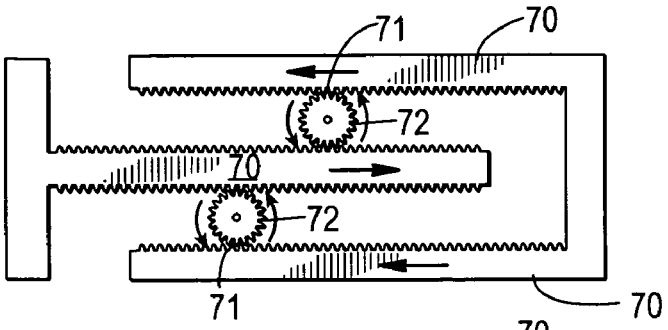
FIG. 17 is a schematic of the media centering assembly shown in FIG. 16.

Between each pair of rack arms is positioned a single one of the pinions 72 that is off the center point. Notably, there may be more than one pinion between each pair of rack arms, such as two pinions between one rack pair to form a particularly stable triangular shape. Regardless, the multiple, off center contact surfaces couple the movement of the U-shaped pair of rack arms 70 and the single rack arm (as shown in FIG. 17) for increased robustness. Also advantageously, the intervening single rack arm provides a somewhat wider interface (e.g., more meshing teeth) with the pinions 72 than another pinion for even more stability.

Figure 19:
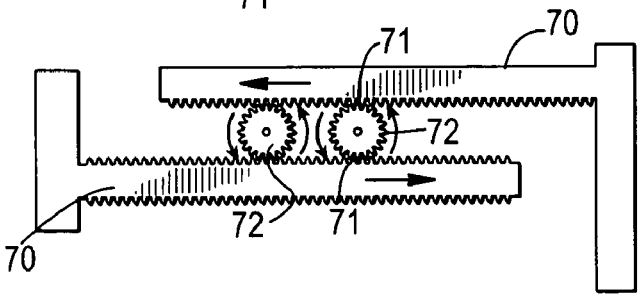
FIG. 19 is a schematic of the media centering assembly shown in FIG. 18.
Figure 18:
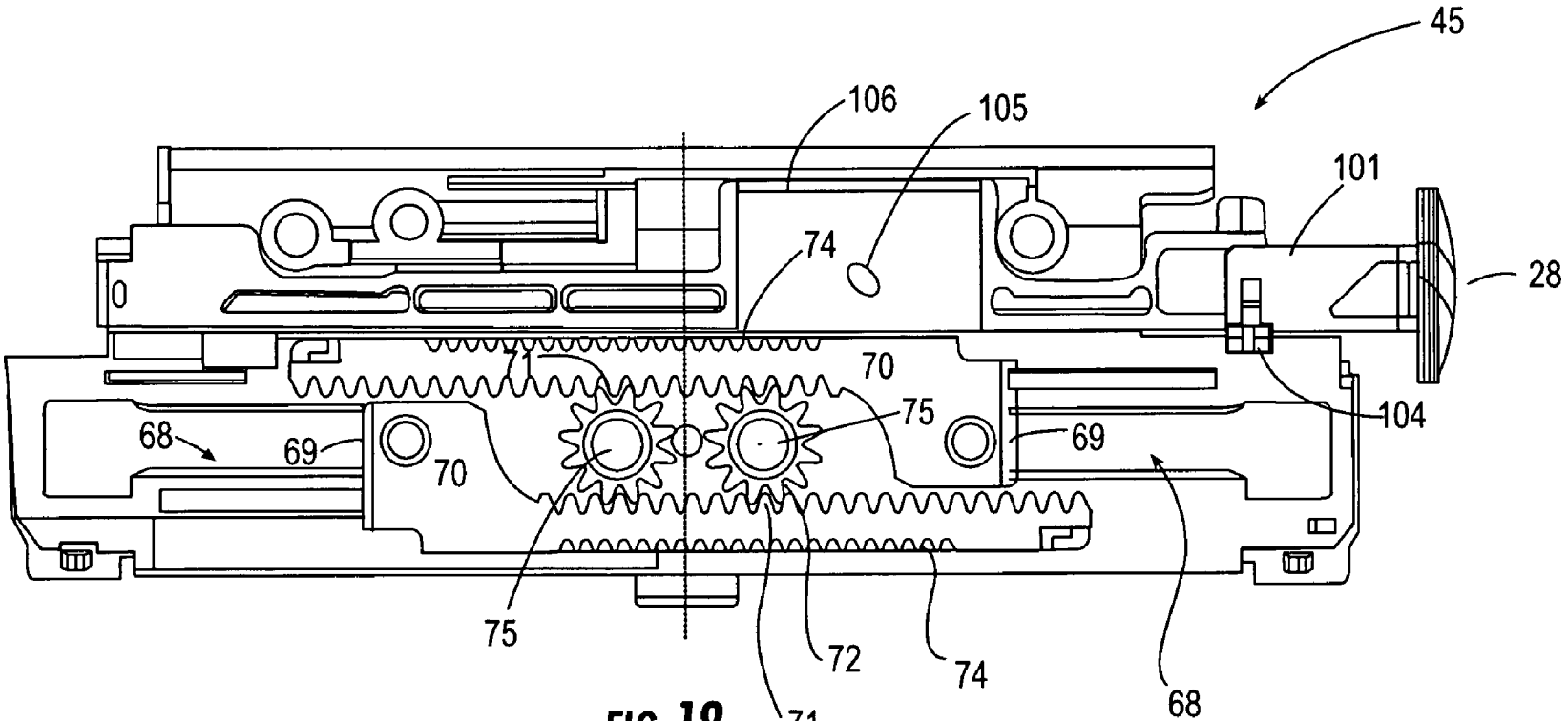
FIG. 18 is a perspective view of a media support assembly of yet another embodiment of the present invention including a media centering assembly with two pinions directly engaging a pair of media support arms.

In another embodiment, the present invention may include the use of two pinions 72 that are spaced apart from each other on opposite sides of the center point and independently extend between two of the rack arm 70, as shown in FIG. 18. Each of the pinions 72 makes direct contact with each rack arm 70 and therefore directly engages the pinion face 71 of each rack arm. The pinions 72 therefore directly couple movement of each rack arm 70 to the other rack arm, as shown in FIG. 19. The lack of an intervening one of the pinions 72 reduces the number of moving parts and allows for larger diameter pinions, both of which tend to increase robustness of operation.

Figure 20:
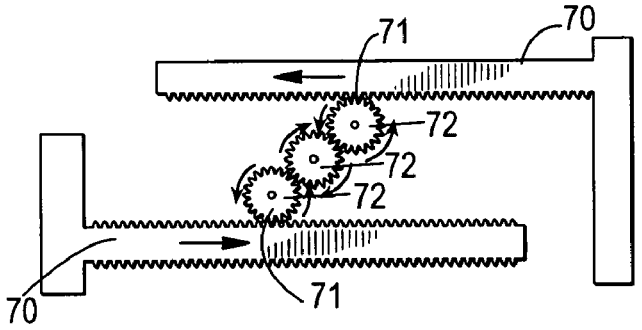
FIG. 20 is a schematic of a media centering assembly of another embodiment of the present invention having three pinions with a middle pinion with an off center position.

Another embodiment shown in FIG. 20 includes the cluster of three pinions 72, similar to the embodiment illustrated in FIGS. 7 and 8, but having the rotational axis of the center one of the pinions 72 offset from the center point.

Figure 21:
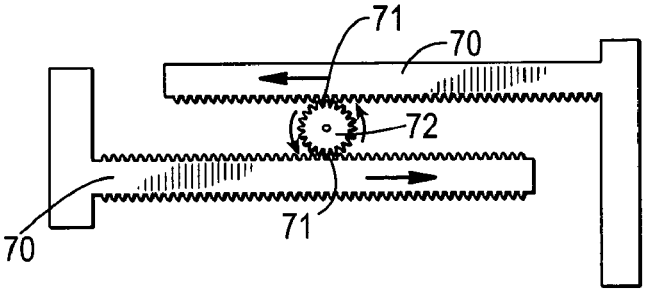
FIG. 21 is a schematic of a media centering assembly of yet another embodiment of the present invention with a single pinion having an off center position.

In another embodiment, shown in FIG. 21, a single one of the pinions 72 is positioned between a pair of the racks 65, but the center of rotation of the pinion is offset from the center point of the media support discs 63 and the media supply roll 54. Offset of the center of rotation of the pinion also offsets the interface between the pinion and the pinion face 71 on each of the racks 65. This provides additional space for other components of the printer 10 that benefit from a centered location.

Figure 22:
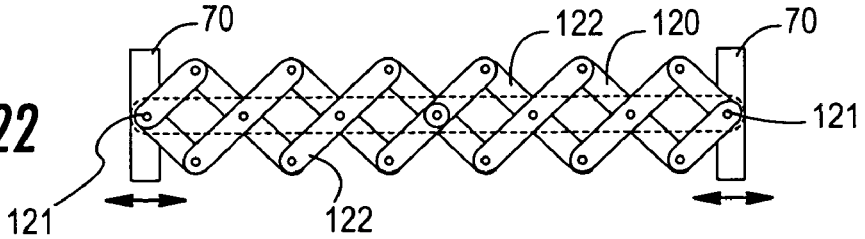
FIG. 22 is a schematic of a media centering assembly of still another embodiment of the present invention including a linkage for coupling movement of media support arms.

Each of the above-described embodiments include variations on the positioning and number of pinions 72 and racks 65. However, off center engagement of the rack arm 70 supporting each of the media support flanges 64 and media support discs 63 can be accomplished with other types of movement coupling devices and still be within the purview of the present invention. For example, as shown in FIG. 22, a "lazy tongs" linkage 120 may be employed with ends 121 rotatably connected to each rack arm 70. The linkage 120 includes a plurality of scissor links 122 rotatably connected at their centers and ends, such as by pins extending through overlapping portions of the scissor links 122. Preferably, the scissor links 122 have equal lengths, and there are an equal number of scissor links on either side of the center point (at which the linkage 120 may be fixed), so that each rack arm 70 is urged an equal amount by the linkage 120.

Notably, due to the interconnection of the scissor links 122, the linkage 120 couples movement of rack arms without relying on engagement of teeth, giving it robust resistance to impacts and drops. The number of scissor links 122 could be modified, such as by adding more or less links, and still couple movement of the racks arms. Further, varied types of linkages could also be used and still be within the purview of the present invention, such as combinations of three and four bar linkages, as long as the centering of the media supply roll 54 is effected by the coupled movement of the media supports.

Figure 23:
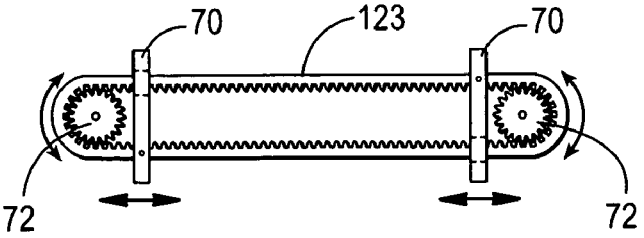
FIG. 23 is a schematic of a media centering assembly of yet another embodiment of the present invention including a pair of pinions and a belt extending over the pinions.

In yet another embodiment, each rack arm 70 is engaged with a toothed belt 123 that extends over two rotatable pinions 72, as shown in FIG. 23. The pinions 72 are spaced apart on either side of the center point with each rack arm 70 positioned between them. In this manner, the toothed belt 123 extends over outer lateral ends of the pinions 72 and through two openings defined each rack arm 70. At one of the openings in the rack arm 70, the toothed belt 123 is fixed to the rack arm 70. In the other one of the openings, the toothed belt 123 moves freely. The openings in which the belt moves freely and is fixed are positioned on alternate sides so as to allow one rack arm 72 to be advanced toward, and moved away from, the other rack arm, as shown in FIG. 23. The amount of wrap around the pinions 72 of the belt allows for the engagement of a large number of teeth for improved impact resistance. This advantage could also be extended with other combinations of belts, such as friction engaging belts, or chains and sprockets, that couple movement of the rack arms, and still be within the purview of the present invention.

Figure 24:
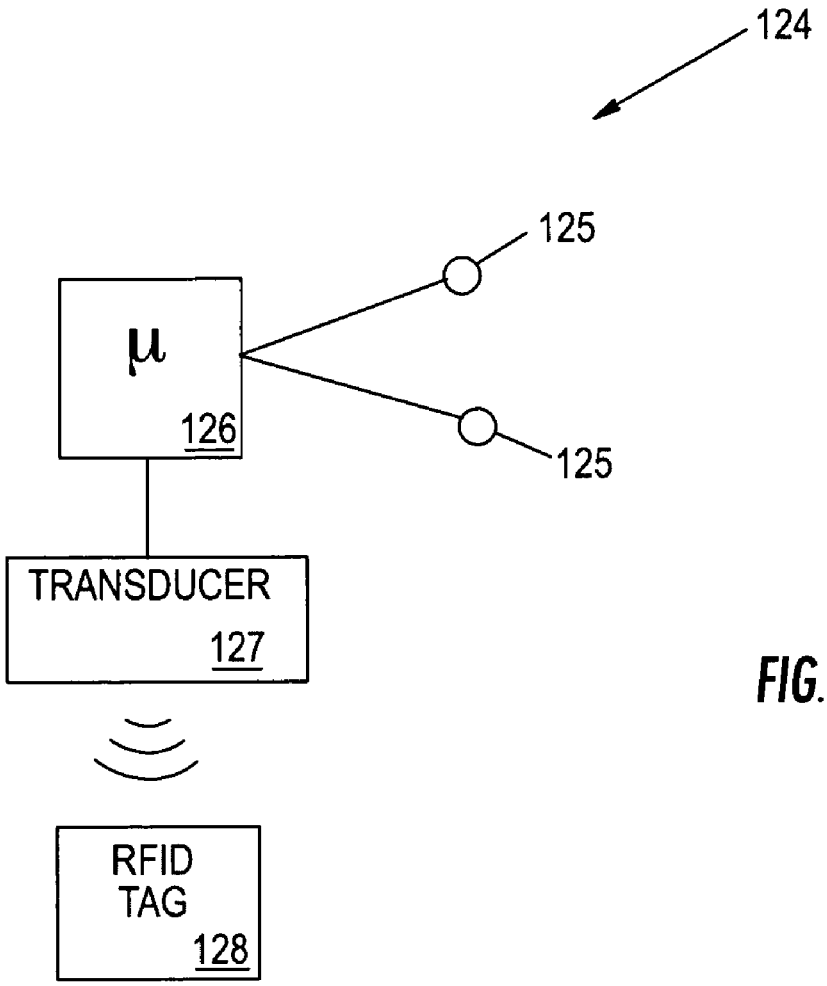
FIG. 24 is a schematic of a rack arm position detecting device of another embodiment of the present invention.

In another embodiment, the printer 10 may include a rack arm position detecting mechanism 124 that uses one or more sensors 125 mounted on the divider wall 53 that detect passing indicia on a back surface the rack arm 72, as shown in FIG. 24. The sensors 125 are connected in communication with a microprocessor 126. The processor includes logic configured to correlate the detection signal from the sensors 125 with the rack arm position. Connected to the processor 126 is a transducer 127 that is configured to broadcast the position data from the processor to a radio frequency identification (RFID) tag 128 mounted to the printer 10, or in proximity to the printer. The RFID tag 128 can then be read by a passing transceiver to determine the current rack arm 72 position which can be correlated with the size of a media roll held therein, or with the printer 10 lacking a media roll.

The present invention has many advantages. The various embodiments of the media centering devices, including the use of different combinations and positioning of the pinions 72, or other movement coupling devices, to engage the rack arms at off center positions that provides additional options for placing other components of the printer 10. For example, moving a pinion off-center with respect to the roll end holders, such as the media support discs 63 and disc support flanges 64, creates room for additional components in printers where space is at a premium. Alternatively, one or more additional pinions 72 extending between the engaged rack pair can be beneficially located in the space created.

Use of multiple pinions 72 to engage the pinion face 71 of each rack arm 70 increases the amount of engagement surface for improved stability of the rack and pinion structure and the roll-holding assembly. Stability is further aided by positioning the pinions 72 to engage each rack arm 70 directly without intervening pinions. Direct engagement also allows the use of larger diameter pinions 72 which have larger engagement surfaces. Use of the belt 123 extending over the pinions 72 also increases the size of the engagement surface for improved impact resistance. The use of linkages can avoid the potential for disengagement of pinion or rack teeth during a drop or impact.

It should be noted that the benefits of multiple pinions can be availed in systems wherein the offset technique is not employed, or extended in an additional aspect of the invention wherein multiple rack pairs are utilized, each with one or more pinions. The use of multiple rack pairs engaging a plurality of pinions provides not only added stability but also durability and redundancy. Redundancy is a benefit to compensate for exaggerated wear of the pinions and or rack pairs in long life printers that experience heavy use.

Many modifications and other embodiments of the inventions set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A printer assembly for dispensing media from a media supply and printing on the media as it is dispensed, the printer assembly comprising:

media support members configured to grip the media supply when the media supply is positioned between the media support members;

two media support arms, wherein each of the media support arms is attached to one of the media support members, wherein each of the media support arms are movable relative to each other along a first sliding axis so as to urge the media support members together to grip the media supply, wherein each of the media support arms includes an engagement surface, and wherein at least one of the media support arms comprises a locking face;

a movable engagement member positioned between the media support arms, said movable engagement member is configured to at least indirectly engage the engagement surface of each of the media support arms so as to couple movement of the media support arms; and a locking member comprising a locking surface that is positionable in a locked position and an unlocked position, wherein the locking surface engages the locking face of the at least one media support member in the locked position; and a latch member configured to engage the locking member that may be movable along a second sliding axis, which is parallel to the first sliding axis, from a first position to a second position, wherein the locking member is moved from the unlocked position to the locked position in response to the latch member moving from the first position to the second position along the second sliding axis.

2. A printer assembly according to claim 1, wherein the latch member is biased towards the first position.

3. A printer assembly according to claim 2, wherein the locking member is biased toward the unlocked position in response to the latch member being biased towards the first position.

4. A printer assembly according to claim 1, wherein the media support members define a centerline extending halfway between the media support members and wherein the engagement surface of each of the media support arms is engaged offset from said center.

5. A printer assembly according to claim 1, wherein the engagement surface of each of the media support arms is one component of a rack pair.

6. A printer assembly according to claim 1, wherein the at least one of the media support arms comprises a spring hook.

7. A new printer assembly according to claim 6, wherein a tension spring configured to bias the media support members toward one another is connected to the spring hook.

8. A printer assembly according to claim 1, further comprising a second movable engagement member positioned between the media support arms, wherein the moveable engagement member is a first pinion and the second moveable engagement member is a second pinion.

9. A printer assembly according to claim 8, wherein the first pinion and the second pinion each directly engage the engagement surface of each of the media support arms.

10. A printer assembly according to claim 1, wherein the locking member further comprises an engagement opening and the latch member further comprises a tracking peg configured to engage the engagement opening.

11. A printer assembly according to claim 10, wherein when the latch member is moved from the first position to the second position, the tracking peg is configured to slide within the engagement opening and cause the locking member to move to locked position.

* * * * *